US011796240B2

(12) United States Patent
Hori

(10) Patent No.: US 11,796,240 B2
(45) Date of Patent: Oct. 24, 2023

(54) COOLER

(71) Applicant: MAKITA CORPORATION, Anjo (JP)

(72) Inventor: Atsushi Hori, Anjo (JP)

(73) Assignee: MAKITA CORPORATION, Anjo (JP)

( * ) Notice: Subject to any disclaimer, the term of this patent is extended or adjusted under 35 U.S.C. 154(b) by 93 days.

(21) Appl. No.: 17/569,825

(22) Filed: Jan. 6, 2022

(65) Prior Publication Data

US 2022/0260299 A1 Aug. 18, 2022

(30) Foreign Application Priority Data

Feb. 18, 2021 (JP) ..... 2021-024142

(51) Int. Cl.
*F25D 11/00* (2006.01)
*F25D 29/00* (2006.01)

(52) U.S. Cl.
CPC ..... *F25D 11/003* (2013.01); *F25D 29/003* (2013.01); *F25D 2400/38* (2013.01)

(58) Field of Classification Search
CPC .. F25D 11/003; F25D 29/003; F25D 2400/38; F25D 2400/12
See application file for complete search history.

(56) References Cited

U.S. PATENT DOCUMENTS

2017/0259956 A1* 9/2017 Hori ..... A45C 13/02
2022/0049890 A1* 2/2022 Alexander ..... A01N 1/0273

FOREIGN PATENT DOCUMENTS

JP 2017122521 A * 7/2017
JP 6769031 B2 10/2020
WO WO-2019187849 A1 * 10/2019 ..... F25B 21/02

OTHER PUBLICATIONS

WO-2019187849-A1 translation.*
JP-2017122521-A translation.*

* cited by examiner

*Primary Examiner* — Elizabeth J Martin
(74) *Attorney, Agent, or Firm* — Oliff PLC

(57) ABSTRACT

A cooler reduces size increase. The cooler includes a main container including a refrigeration compartment, and a battery mount set including a first battery mount to which a first battery is attachable and a second battery mount to which a second battery different from the first battery is attachable. The first battery mount and the second battery mount are positioned relative to each other to cause the second battery to be unattachable to the second battery mount when the first battery is attached to the first battery mount and to cause the first battery to be unattachable to the first battery mount when the second battery is attached to the second battery mount.

20 Claims, 19 Drawing Sheets

COOLER

CROSS-REFERENCE TO RELATED APPLICATIONS

This application claims the benefit of priority to Japanese Patent Application No. 2021-024142, filed on Feb. 18, 2021, the entire contents of which are hereby incorporated by reference.

BACKGROUND

1. Technical Field

The present disclosure relates to a cooler.

2. Description of the Background

In the field of coolers, a known temperature adjustment container uses a battery pack (battery) as a power supply, as one example is described in Japanese Patent No. 6769031.

BRIEF SUMMARY

Different types of batteries are available in the market. A technique for reducing size increase is awaited for a cooler that uses different types of batteries as a power supply.

One or more aspects of the present disclosure are directed to a cooler that reduces size increase.

A first aspect of the present disclosure provides a cooler, including:

a main container including a refrigeration compartment; and a battery mount set including a first battery mount to which a first battery is attachable and a second battery mount to which a second battery different from the first battery is attachable, wherein the first battery mount and the second battery mount are positioned relative to each other to cause the second battery to be unattachable to the second battery mount when the first battery is attached to the first battery mount and to cause the first battery to be unattachable to the first battery mount when the second battery is attached to the second battery mount.

The cooler according to the above aspect of the present disclosure reduces size increase.

DETAILED DESCRIPTION

Embodiments

Embodiments will now be described. In the embodiments, the positional relationships between the components will be described using the directional terms such as front and rear (or frontward and rearward), right and left (or lateral), and up and down (or vertical). The terms indicate relative positions or directions with respect to the center of a cooler 1.

Cooler

Figure 1:
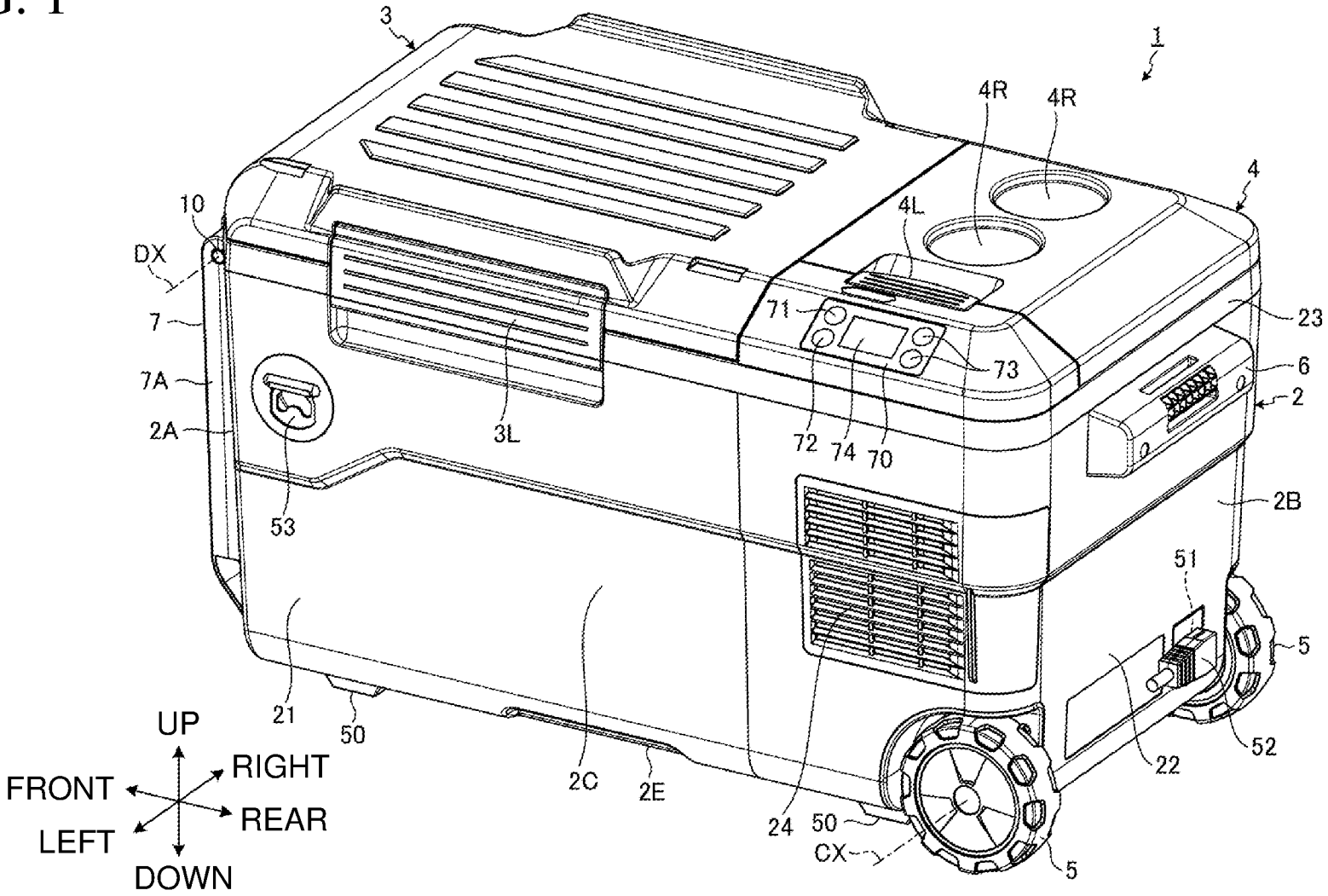
FIG. 1 is a rear perspective view of a cooler according to an embodiment.
Figure 2:
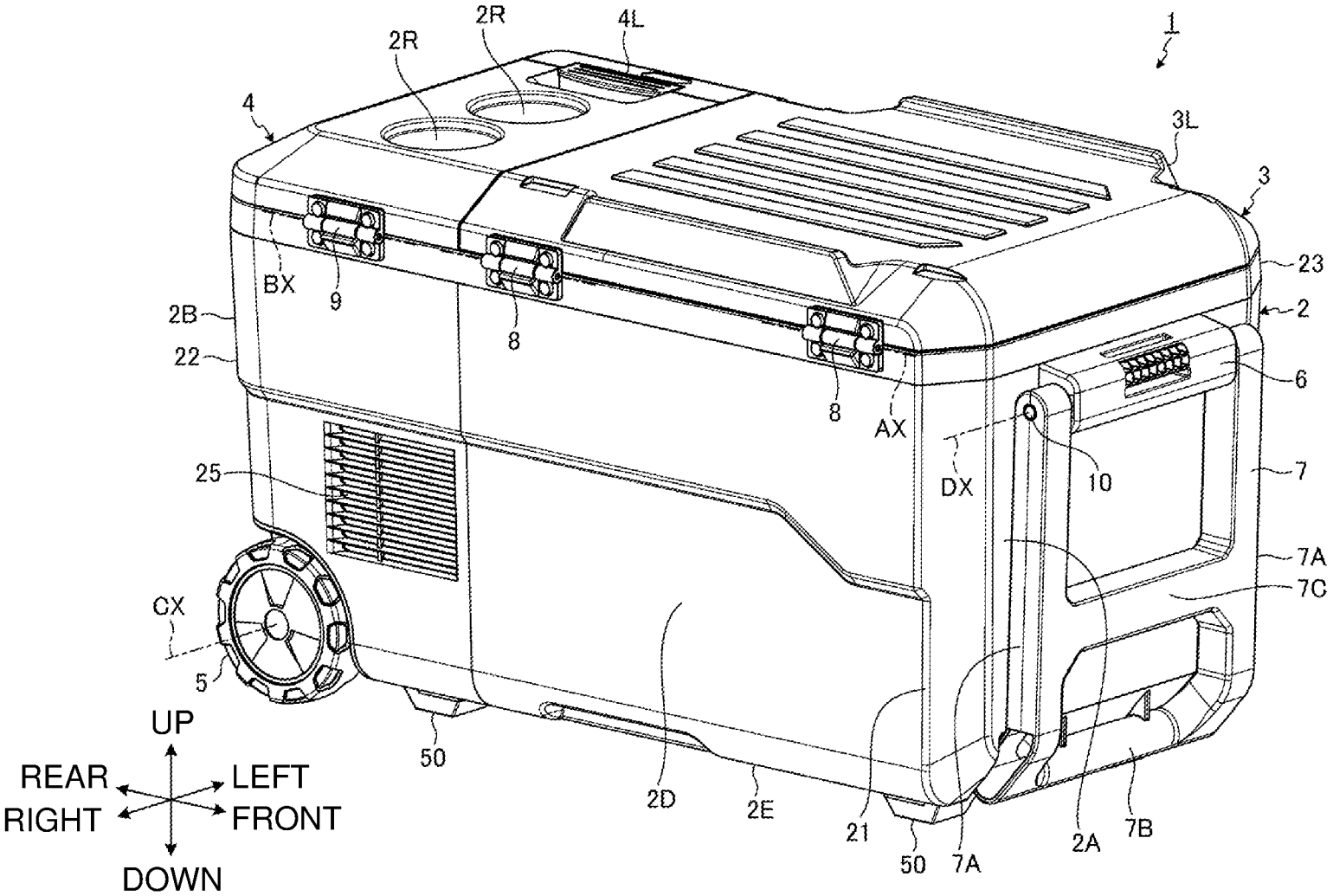
FIG. 2 is a front perspective view of the cooler according to the embodiment.
Figure 3:
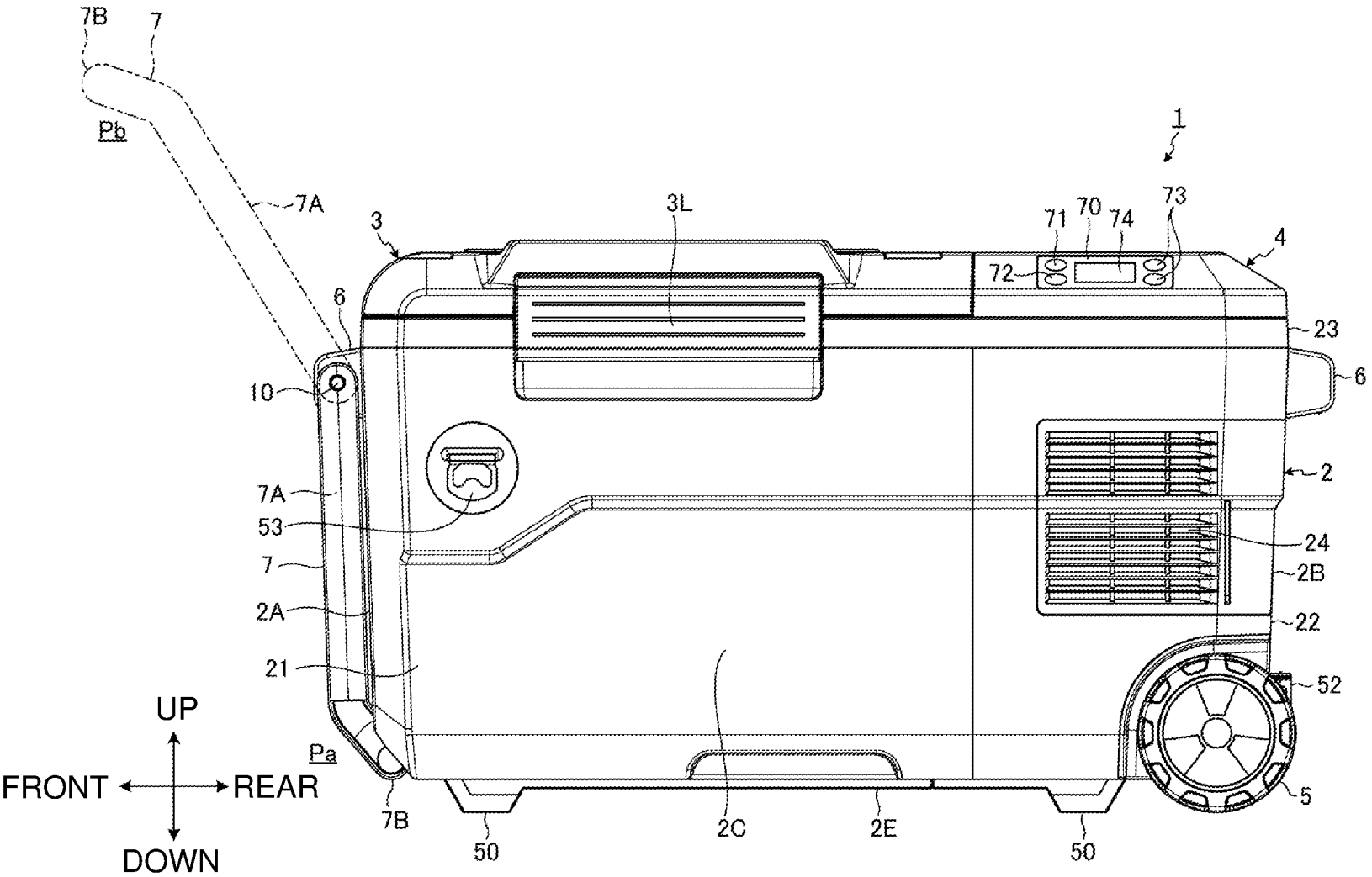
FIG. 3 is a left side view of the cooler according to the embodiment.

FIG. 1 is a rear perspective view of the cooler 1 according to the embodiment. FIG. 2 is a front perspective view of the cooler 1 according to the embodiment. FIG. 3 is a left side view of the cooler 1 according to the embodiment.

The cooler 1 has cooling capabilities to keep products cold. The cooler 1 according to the embodiment also has warming capabilities to keep products warm. In other words, the cooler 1 according to the embodiment functions as a cooler and a warmer.

As shown in FIGS. 1 to 3, the cooler 1 includes a housing 2, a refrigeration compartment cover 3, a battery compartment cover 4, casters 5, a pair of handles 6, and a carrier handle 7.

The housing 2 is an enclosure of the cooler 1. The housing 2 has a front surface 2A, a rear surface 2B, a left surface 2C, a right surface 2D, and a lower surface 2E. The housing 2 has an opening at the top. The housing 2 has four legs 50 on the lower surface 2E. The legs 50 protrude downward from the lower surface 2E.

The housing 2 in the embodiment includes a front housing 21, a rear housing 22, and a frame housing 23. The rear housing 22 is located rearward from the front housing 21. The front housing 21 has a rear edge connected to a front edge of the rear housing 22. The frame housing 23 is connected to an upper edge of the front housing 21 and to an upper edge of the rear housing 22. The front housing 21 includes the front surface 2A, a front portion of the left surface 2C, a front portion of the right surface 2D, and a front portion of the lower surface 2E. The rear housing 22 includes the rear surface 2B, a rear portion of the left surface 2C, a rear portion of the right surface 2D, and a rear portion of the lower surface 2E.

The refrigeration compartment cover 3 covers a part of the opening of the housing 2. The refrigeration compartment cover 3 in the embodiment covers a front part of the opening of the housing 2. The refrigeration compartment cover 3 is joined to the housing 2 with hinge assemblies 8. The hinge assemblies 8 in the embodiment join a right edge of the refrigeration compartment cover 3 to an upper portion of the right surface 2D of the front housing 21. The hinge assemblies 8 have their hinge axis AX extending in the front-rear direction. The refrigeration compartment cover 3 is pivotable about the hinge axis AX. The refrigeration compartment cover 3 has the right edge connected to the hinge assemblies 8 and thus has its left edge rotatable about the hinge axis AX.

The battery compartment cover 4 covers a part of the opening of the housing 2. The battery compartment cover 4 is located rearward from the refrigeration compartment cover 3. The battery compartment cover 4 in the embodiment covers a rear part of the opening of the housing 2. The battery compartment cover 4 is joined to the housing 2 with a hinge assembly 9. The hinge assembly 9 in the embodiment joins a right edge of the battery compartment cover 4 to an upper portion of the right surface 2D of the rear housing 22. The hinge assembly 9 has its hinge axis BX extending in the front-rear direction. The battery compartment cover 4 is pivotable about the hinge axis BX. The battery compartment cover 4 has the right edge connected to the hinge assembly 9 and thus has its left edge rotatable about the hinge axis BX.

In the embodiment, the hinge axis AX of the hinge assemblies 8 and the hinge axis BX of the hinge assembly 9 substantially align with each other. The refrigeration compartment cover 3 and the battery compartment cover 4 are pivotable in substantially the same direction.

The casters 5 each include a wheel or a roller. The casters 5 are rotatably supported on a lower rear portion of the housing 2. The casters 5 each have a rotation axis CX extending laterally.

The handles 6 are grippable by a user of the cooler 1. The pair of handles 6 include a first handle 6 fixed on an upper portion of the front surface 2A, and a second handle 6 fixed on an upper portion of the rear surface 2B. The first handle 6 protrudes frontward from the front surface 2A. The second handle 6 protrudes rearward from the rear surface 2B. The user of the cooler 1 grips the pair of handles 6 to lift the cooler 1.

The carrier handle 7 is grippable by the user of the cooler 1. The carrier handle 7 includes a pair of arms 7A, a handle portion 7B, and a connector 7C. The handle portion 7B connects a distal end of a first arm 7A to a distal end of a second arm 7A. The connector 7C connects a middle portion of the first arm 7A to a middle portion of the second arm 7A. The carrier handle 7 is joined to the housing 2 with a hinge assembly 10. The handle 6 fixed on the upper portion of the front surface 2A includes the hinge assembly 10 in the embodiment. The hinge assembly 10 has its hinge axis DX extending laterally. The carrier handle 7 is pivotable about the hinge axis DX. Each arm 7A has a basal end connected to the hinge assembly 10. The handle portion 7B is thus rotatable about the hinge axis DX.

As shown in FIG. 3, the carrier handle 7 is pivotable to a retracted position Pa and to an in-use position Pb. At the retracted position Pa, the carrier handle 7 has the handle portion 7B below the hinge assembly 10, and the arms 7A facing the front surface 2A of the housing 2. At the in-use position Pb, the carrier handle 7 has the arms 7A away from the front surface 2A of the housing 2, and the handle portion 7B above the hinge assembly 10. The user of the cooler 1 moves the carrier handle 7 to the in-use position Pb, and then can walk while gripping the handle portion 7B. While the user of the cooler 1 gripping the handle portion 7B is walking, the casters 5 are in contact with the ground and the legs 50 remain away from the ground. The user of the cooler 1 can easily move the cooler 1 with the casters 5 rotating.

A power jack 51 connectable to utility power or a cigarette socket is located on a right lower portion of the rear surface 2B. The power jack 51 is covered by a cover. The power jack 51 is connectable to an alternating-current (AC) adapter for utility power or to a connector plug 52 for a cigarette socket cord. The user of the cooler 1 can open the cover and connect the power jack 51 to the connector plug 52. The user may connect the power plug for an AC adapter to the power outlet for utility power. The user may connect a cigarette plug for a cigarette socket cord to a cigarette socket. A bottle opener 53 is located on a front portion of the left surface 2C.

Figure 4:
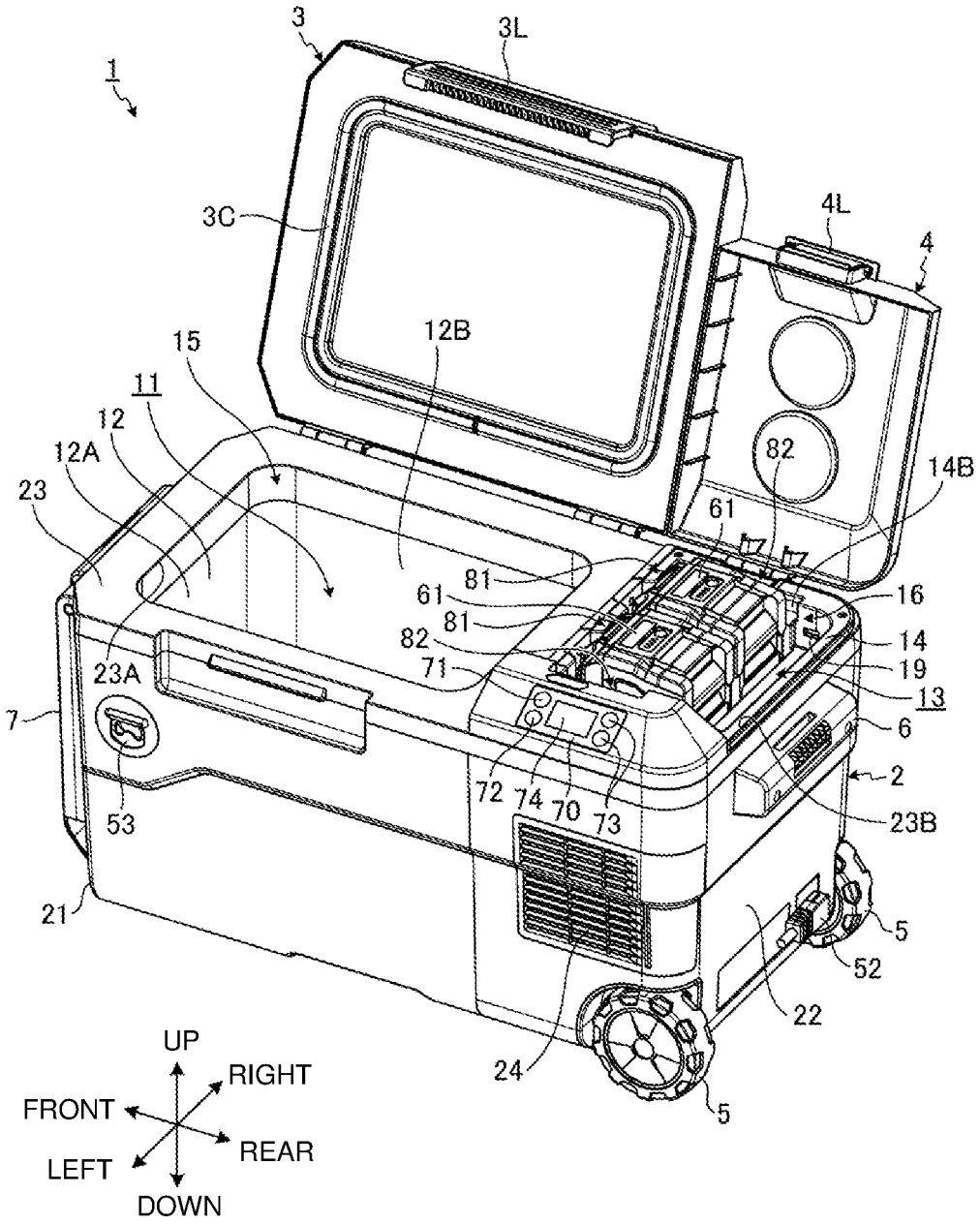
FIG. 4 is a rear perspective view of the cooler according to the embodiment.
Figure 5:
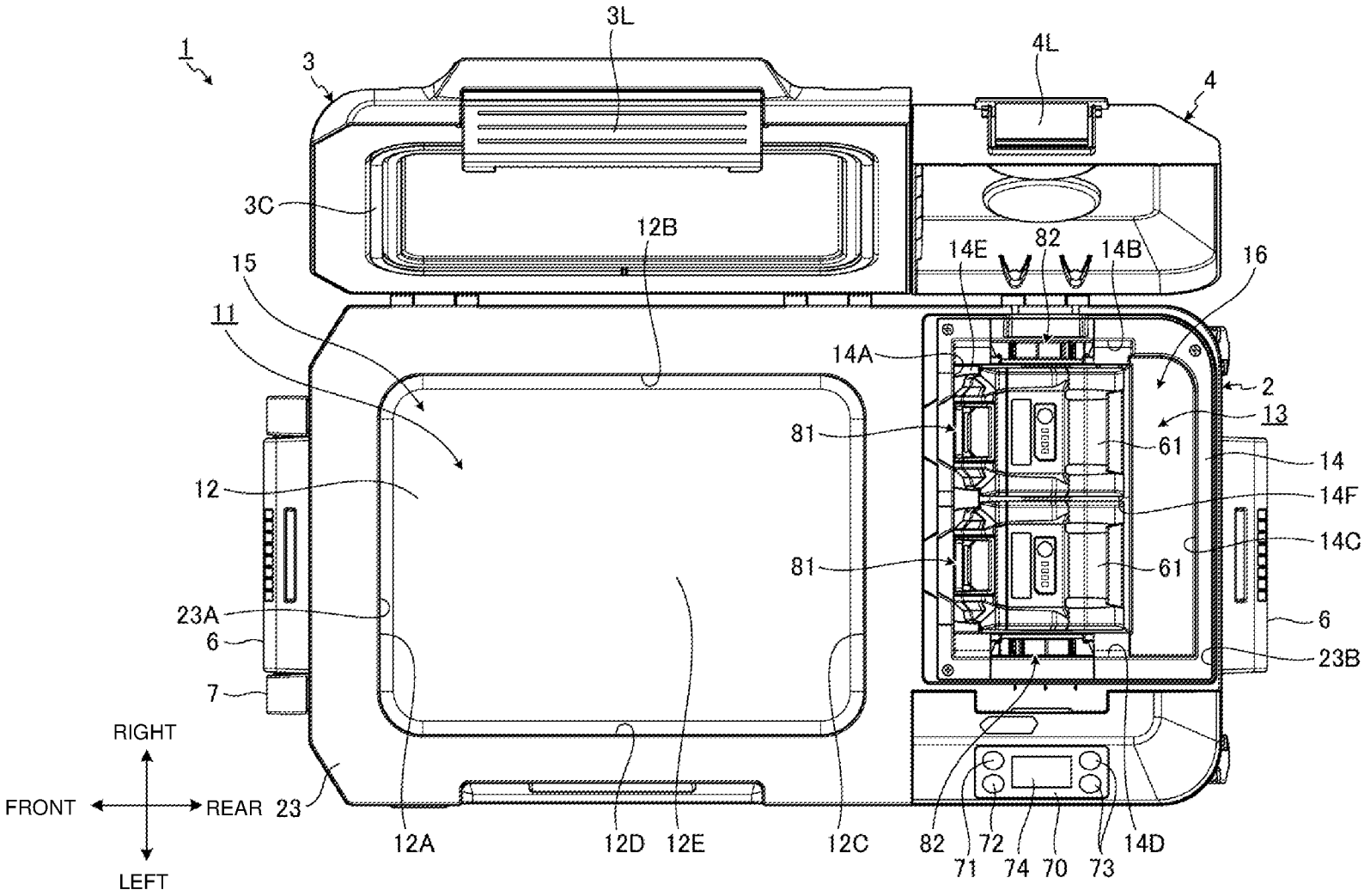
FIG. 5 is a top view of the cooler according to the embodiment.

FIG. 4 is a rear perspective view of the cooler 1 according to the embodiment. FIG. 5 is a top view of the cooler 1 according to the embodiment. In FIGS. 4 and 5, the refrigeration compartment cover 3 and the battery compartment cover 4 are pivoted rightward.

As shown in FIGS. 4 and 5, the cooler 1 includes a main container 12 including a refrigeration compartment 11 and a battery container 14 including a battery compartment 13. The battery container 14 is located adjacent to the main container 12. The battery container 14 in the embodiment is located rearward from the main container 12. The main container 12 is accommodated in the front housing 21. The battery container 14 is accommodated in the rear housing 22.

The main container 12 has a first inner surface 12A, a second inner surface 12B, a third inner surface 12C, a fourth inner surface 12D, and a bottom surface 12E.

The first inner surface 12A faces rearward. The second inner surface 12B faces leftward. The third inner surface 12C faces frontward. The fourth inner surface 12D faces rightward. The bottom surface 12E faces upward. The first inner surface 12A and the third inner surface 12C face each other. The second inner surface 12B and the fourth inner surface 12D face each other. The bottom surface 12E meets the lower end of the first inner surface 12A, the lower end of the second inner surface 12B, the lower end of the third inner surface 12C, and the lower end of the fourth inner surface 12D.

Of the first to fourth inner surfaces 12A to 12D and the bottom surface 12E, the second inner surface 12B is closest to the hinge assemblies 8. The third inner surface 12C is closest to the battery compartment 13.

The refrigeration compartment 11 is defined by the first to fourth inner surfaces 12A to 12D and the bottom surface 12E. The refrigeration compartment 11 has an opening 15 at the top.

The cooler 1 according to the embodiment functions as a cooler and a warmer. The refrigeration compartment 11 functions as a refrigeration and heating compartment. Products to be kept cold or warm are stored in the refrigeration compartment 11.

The battery container 14 has a first inner surface 14A, a second inner surface 14B, a third inner surface 14C, a fourth inner surface 14D, and a bottom surface 14E.

The first inner surface 14A faces rearward. The second inner surface 14B faces leftward. The third inner surface 14C faces frontward. The fourth inner surface 14D faces rightward. The bottom surface 14E faces upward. The first inner surface 14A and the third inner surface 14C face each other. The second inner surface 14B and the fourth inner surface 14D face each other. The bottom surface 14E meets the lower end of the first inner surface 14A, the lower end of the second inner surface 14B, the lower end of the third inner surface 14C, and the lower end of the fourth inner surface 14D.

Of the first to fourth inner surfaces 14A to 14D and the bottom surface 14E, the second inner surface 14B is closest to the hinge assembly 9. The first inner surface 14A is closest to the refrigeration compartment 11.

The battery compartment 13 is defined by the first to fourth inner surfaces 14A to 14D and the bottom surface 14E. The battery compartment 13 has an opening 16 at the top.

The frame housing 23 has a first opening 23A and a second opening 23B. The second opening 23B is located rearward from the first opening 23A. The opening 15 of the refrigeration compartment 11 is located inside the first opening 23A and connects to the first opening 23A. The opening 16 of the battery compartment 13 is located inside the second opening 23B.

The refrigeration compartment cover 3 is operable to cover and uncover the opening 15 of the refrigeration compartment 11. The refrigeration compartment cover 3 is pivotable with its left edge away from the frame housing 23 to uncover the opening 15 of the refrigeration compartment 11. The refrigeration compartment cover 3 is pivotable with its left edge toward the frame housing 23 to cover the opening 15 of the refrigeration compartment 11. The refrigeration compartment cover 3 includes a latch assembly 3L. With the refrigeration compartment cover 3 covering the opening 15 of the refrigeration compartment 11, the latch assembly 3L is at the left edge of the refrigeration compartment cover 3. The latch assembly 3L fastens the refrigeration compartment cover 3 covering the opening 15 of the refrigeration compartment 11 and the frame housing 23 together.

The refrigeration compartment cover 3 in the embodiment includes a heat insulator. The refrigeration compartment cover 3 includes a seal 3C on its inner surface. The seal 3C is a rubber ring. When the refrigeration compartment cover 3 covers the opening 15 of the refrigeration compartment 11, the seal 3C comes in contact with the upper surface of the frame housing 23. The seal 3C in contact with the upper surface of the frame housing 23 hermetically seals the refrigeration compartment 11.

The battery compartment cover 4 is operable to cover and uncover the opening 16 of the battery compartment 13. The battery compartment cover 4 is pivotable with its left edge away from the frame housing 23 to uncover the opening 16 of the battery compartment 13. The battery compartment cover 4 is pivotable with its left edge toward the frame housing 23 to cover the opening 16 of the battery compartment 13. The battery compartment cover 4 includes a latch assembly 4L. With the battery compartment cover 4 covering the opening 16 of the battery compartment 13, the latch assembly 4L is at the left edge of the battery compartment cover 4. The latch assembly 4L fastens the battery compartment cover 4 covering the opening 16 of the battery compartment 13 and the frame housing 23 together.

As shown in FIGS. 1 and 2, the battery compartment cover 4 has two recesses 4R on its surface in the embodiment. The user of the cooler 1 can place a cup in either recess 4R.

Battery and Battery Mount

As shown in FIGS. 4 and 5, the cooler 1 includes first battery mounts 81 and second battery mounts 82. The first and second battery mounts 81 and 82 are accommodated in the battery compartment 13. The first battery mounts 81 each receive a first battery 61. The second battery mounts 82 each receive a second battery 62.

Figure 6:
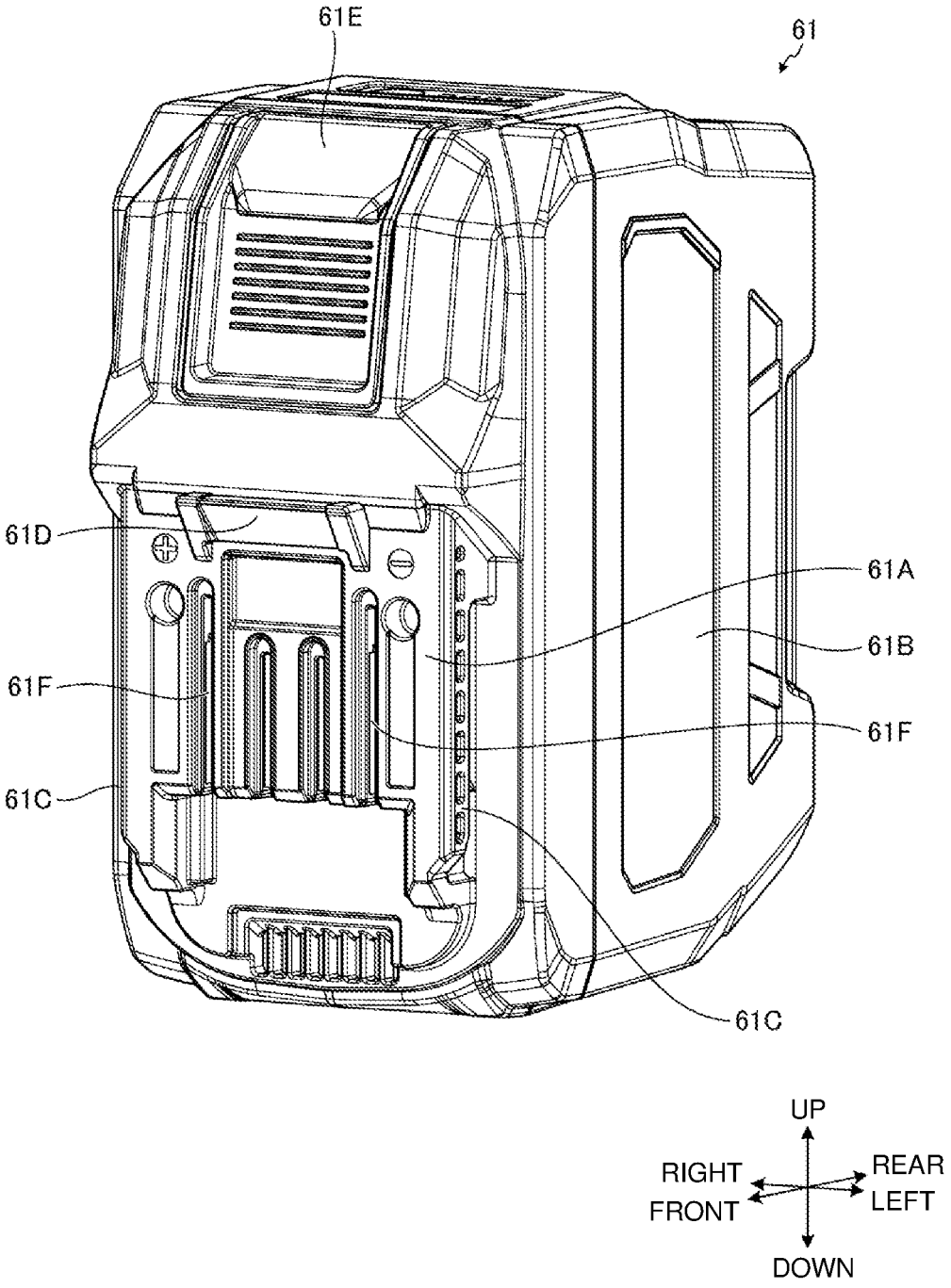
FIG. 6 is a perspective view of a first battery in the embodiment.

FIG. 6 is a perspective view of the first battery 61 in the embodiment. The first battery 61 supplies power to the cooler 1. The first battery 61 thus functions as a power supply for the cooler 1. The first battery 61 includes a secondary battery. The first battery 61 in the embodiment includes a rechargeable lithium-ion battery.

The first battery 61 is slidable. The first battery 61 is a battery for power tools. The first battery 61 is attachable to the first battery mount 81 to supply power to the cooler 1.

The first battery 61 includes a housing 61B, a pair of slides 61C, a protrusion 61D, a release button 61E, and a pair of power terminals 61F. The housing 61B has a mount surface 61A. The protrusion 61D is supported movably on the housing 61B. The release button 61E is operable to move the protrusion 61D. The housing 61B has an internal space to accommodate a battery cell. The battery cell is a rechargeable lithium-ion battery. The slides 61C extend vertically. The protrusion 61D is supported movably by a spring. The protrusion 61D protrudes from the mount surface 61A under an elastic force from the spring. The power terminals 61F are located between the pair of slides 61C. A first power terminal 61F is a positive power terminal. A second power terminal 61F is a negative power terminal.

Figure 7:
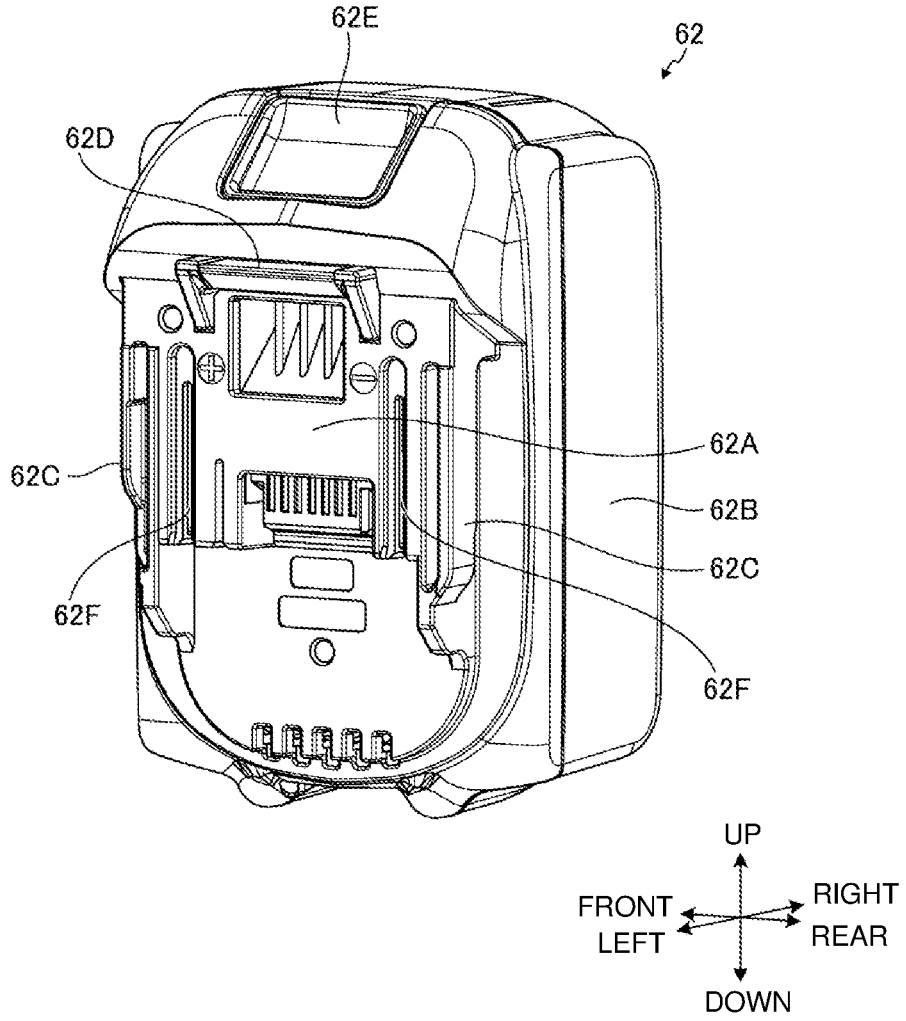
FIG. 7 is a perspective view of a second battery in the embodiment.

FIG. 7 is a perspective view of the second battery 62 in the embodiment. The second battery 62 supplies power to the cooler 1. The second battery 62 thus functions as a power supply for the cooler 1. The second battery 62 includes a secondary battery. The second battery 62 in the embodiment includes a rechargeable lithium-ion battery.

The second battery 62 is slidable. The second battery 62 is a battery for power tools. The second battery 62 is attachable to the second battery mount 82 to supply power to the cooler 1.

The second battery 62 includes a housing 62B, a pair of slides 62C, a protrusion 62D, a release button 62E, and a pair of power terminals 62F. The housing 62B has a mount surface 62A. The protrusion 62D is supported movably on the housing 62B. The release button 62E is operable to move the protrusion 62D. The housing 62B has an internal space to accommodate a battery cell. The battery cell is a rechargeable lithium-ion battery. The slides 62C extend vertically. The protrusion 62D is supported movably by a spring. The protrusion 62D protrudes from the mount surface 62A under an elastic force from the spring. The power terminals 62F are located between the pair of slides 62C. A first power terminal 62F is a positive power terminal. A second power terminal 62F is a negative power terminal.

The first battery 61 and the second battery 62 are of different types. The cooler 1 may use, as its power supply, different types of batteries for the first battery 61 and the second battery 62.

The first battery 61 and the second battery 62 differ in rated voltage (V). The first battery 61 has a higher rated voltage than the second battery 62. The first battery 61 has a rated voltage of, for example, 36 V. The second battery 62 has a rated voltage of, for example, 18 V. The first battery 61 may have a rated voltage of 14.4 V. The second battery 62 may have a rated voltage of 10.8 V.

The first battery 61 and the second battery 62 differ in capacity (Ah). The first battery 61 has a higher capacity than the second battery 62.

The first battery 61 and the second battery 62 differ in weight (g). The first battery 61 is heavier than the second battery 62.

The first battery 61 and the second battery 62 differ in outer dimensions (mm). The first battery 61 has greater outer dimensions than the second battery 62.

Figure 8:
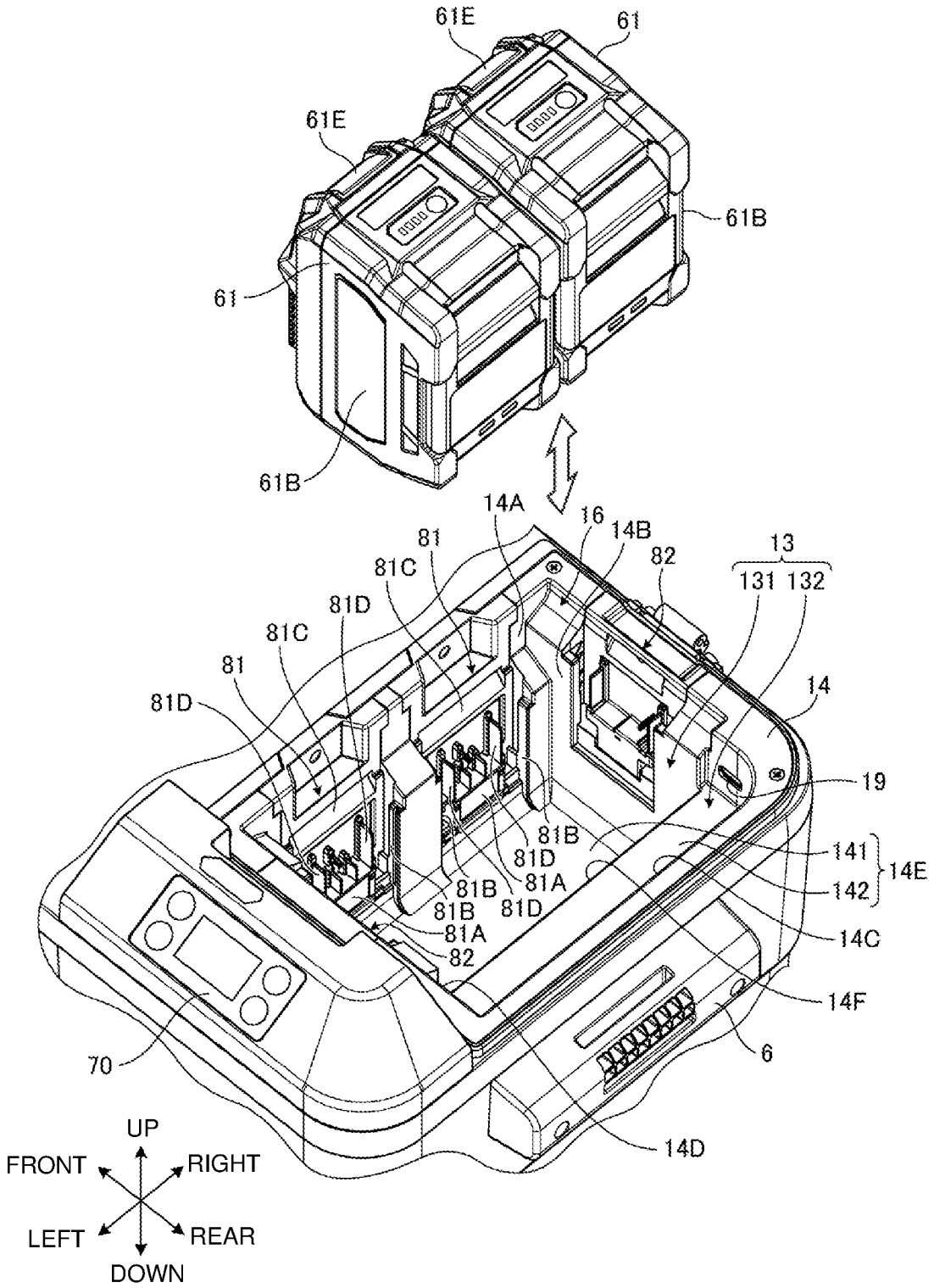
FIG. 8 is a perspective view of first batteries and first battery mounts in the embodiment.

FIG. 8 is a perspective view of the first batteries 61 and the first battery mounts 81 in the embodiment.

The two first battery mounts 81 are arranged laterally on the first inner surface 14A of the battery compartment 13.

The first battery mounts 81 each have a mount surface 81A, guides 81B, a lock slot 81C, and power terminals 81D.

The mount surface 81A faces the mount surface 61A of the first battery 61.

The guides 81B guide the first battery 61 in a predetermined guiding direction (vertical direction in the present embodiment). The slides 61C on the first battery 61 are guided along the guides 81B. The first battery mount 81 includes two guides 81B arranged laterally.

The lock slot 81C is located in the mount surface 81A. The lock slot 81C receives the protrusion 61D on the first battery 61. This fastens the first battery 61 to the first battery mount 81. In response to an operation on the release button 61E, the first battery 61 is unlocked and released from the first battery mount 81.

The power terminals 81D are connected to the power terminals 61F on the first battery 61 to supply power from the first battery 61 to the cooler 1.

To attach the first battery 61 to the first battery mount 81, the user of the cooler 1 slides the first battery 61 downward along the first battery mount 81 after placing the slides 61C on the first battery 61 in contact with the guides 81B on the first battery mount 81. The first battery 61 is guided along the guides 81B to move downward. With the protrusion 61D on the first battery 61 received in the lock slot 81C in the first battery mount 81, the first battery 61 is fastened to the first battery mount 81. The first battery 61 is thus attached to the first battery mount 81. The power terminals 61F on the first battery 61 are connected to the power terminals 81D on the first battery mount 81 to supply power from the first battery 61 to the cooler 1.

To detach the first battery 61 from the first battery mount 81, the user of the cooler 1 operates the release button 61E. The protrusion 61D is thus removed from the lock slot 81C. This unlocks the first battery 61 to be released from the first battery mount 81. The first battery 61 is then slid upward and detached from the first battery mount 81.

In this manner, the first battery 61 is slidable vertically for attachment to and detachment from the first battery mount 81. The battery compartment cover 4 is pivoted to uncover the opening 16 of the battery compartment 13 before the first battery 61 is attached to or detached from the first battery mount 81.

Figure 9:
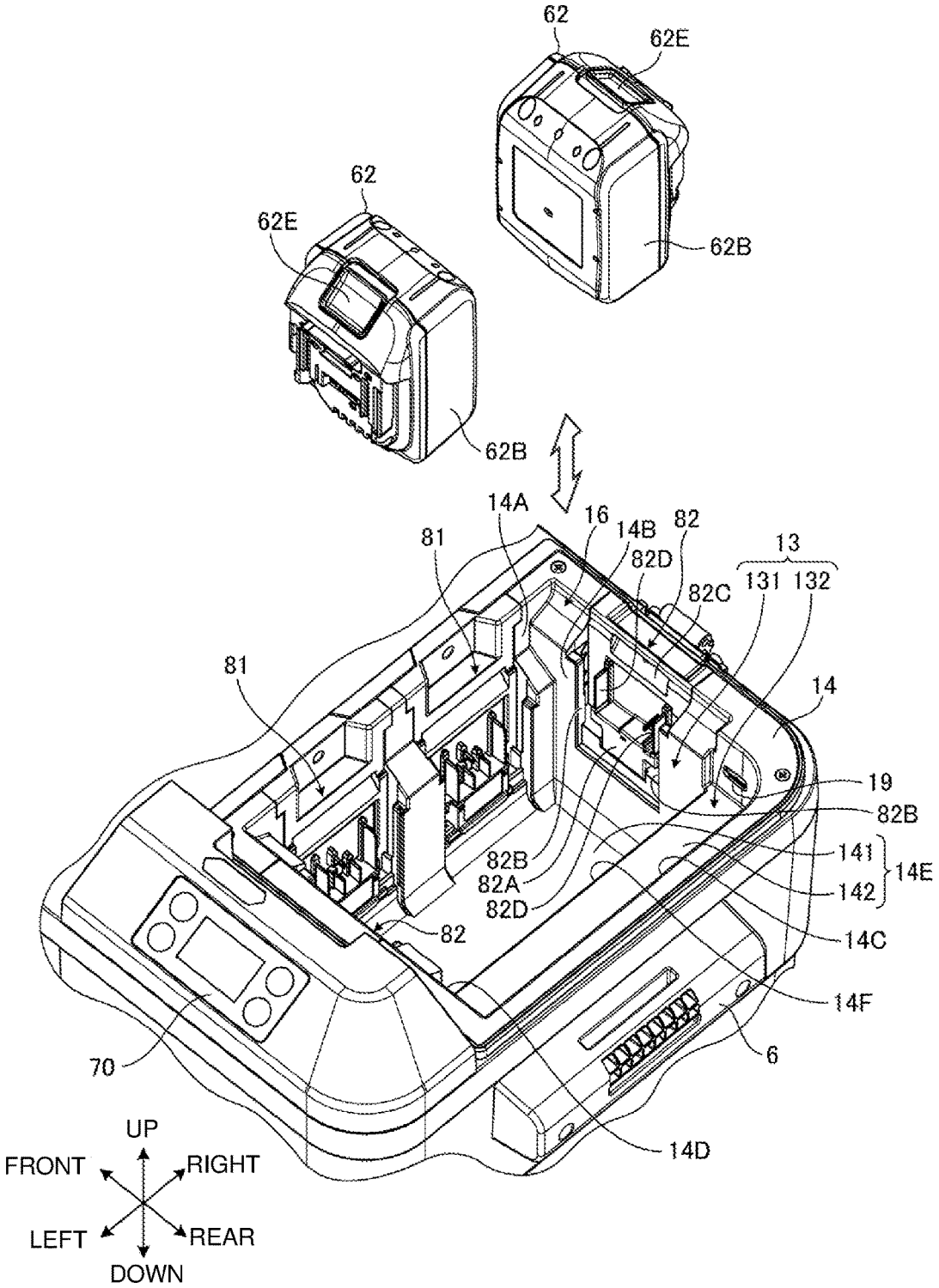
FIG. 9 is a perspective view of second batteries and second battery mounts in the embodiment.

FIG. 9 is a perspective view of the second batteries 62 and the second battery mounts 82 in the embodiment.

The second battery mounts 82 are located on the second inner surface 14B and the fourth inner surface 14D of the battery compartment 13. More specifically, one second battery mount 82 is located on the second inner surface 14B and the other second battery mount 82 is located on the fourth inner surface 14D.

The second battery mounts 82 each have a mount surface 82A, guides 82B, a lock slot 82C, and power terminals 82D.

The mount surface 82A faces the mount surface 62A of the second battery 62.

The guides 82B guide the second battery 62 in a predetermined guiding direction (vertical direction in the present embodiment). The slides 62C on the second battery 62 are guided along the guides 82B. The second battery mount 82 includes the two guides 82B arranged in the front-rear direction.

The lock slot 82C is located in the mount surface 82A. The lock slot 82C receives the protrusion 62D on the second battery 62. This fastens the second battery 62 to the second battery mount 82. In response to an operation on the release button 62E, the second battery 62 is unlocked and released from the second battery mount 82.

The power terminals 82D are connected to the power terminals 62F on the second battery 62 to supply power from the second battery 62 to the cooler 1.

To attach the second battery 62 to the second battery mount 82, the user of the cooler 1 slides the second battery 62 downward along the second battery mount 82 after placing the slides 62C on the second battery 62 in contact with the guides 82B on the second battery mount 82. The second battery 62 is guided along the guides 82B to move downward. With the protrusion 62D on the second battery 62 received in the lock slot 82C in the second battery mount 82, the second battery 62 is fastened to the second battery mount 82. The second battery 62 is thus attached to the second battery mount 82. The power terminals 62F on the second battery 62 are connected to the power terminals 82D on the second battery mount 82 to supply power from the second battery 62 to the cooler 1.

To detach the second battery 62 from the second battery mount 82, the user of the cooler 1 operates the release button 62E. The protrusion 62D is thus removed from the lock slot 82C. This unlocks the second battery 62 to be released from the second battery mount 82. The second battery 62 is then slid upward and detached from the second battery mount 82.

In this manner, the second battery 62 is slidable vertically for attachment to and detachment from the second battery mount 82. The battery compartment cover 4 is pivoted to uncover the opening 16 of the battery compartment 13 before the second battery 62 is attached to or detached from the second battery mount 82.

The first battery mount 81 and the second battery mount 82 have different structures at their interfaces. The mount surface 81A, the guides 81B, and the power terminals 81D are at relative positions different from the relative positions of the mount surface 82A, the guides 82B, and the power terminals 82D. For example, the pair of guides 81B have a distance between them different from the distance between the pair of guides 82B. The pair of power terminals 81D have a distance between them different from the distance between the pair of power terminals 82D. The mount surface 81A has dimensions different from the dimensions of the mount surface 82A. The mount surface 81A has a profile different from the profile of the mount surface 82A.

The first battery mount 81 receives the first battery 61 with a first rated voltage. The second battery mount 82 receives the second battery 62 with a second rated voltage different from the first rated voltage. The first battery mount 81 receives the first battery 61 with first outer dimensions. The second battery mount 82 receives the second battery 62 with second outer dimensions different from the first outer dimensions.

As described above, the battery compartment 13 is defined by the first to fourth inner surfaces 14A to 14D and the bottom surface 14E. As shown in FIGS. 8 and 9, the bottom surface 14E includes a first bottom surface 141 and a second bottom surface 142. The second bottom surface 142 is located above the first bottom surface 141. The first bottom surface 141 is located frontward from the second bottom surface 142. This forms a step between the first bottom surface 141 and the second bottom surface 142. The first bottom surface 141 has its rear end connected to the front end of the second bottom surface 142 with a step surface 14F. The step surface 14F faces frontward.

The battery compartment 13 includes a first space 131 and a second space 132. The first space 131 is located frontward from the second space 132. The first space 131 is defined by the first inner surface 14A, a front portion of the second inner surface 14B, the step surface 14F, a front portion of the fourth inner surface 14D, and the first bottom surface 141. The second space 132 is defined by a rear portion of the second inner surface 14B, the third inner surface 14C, a rear portion of the fourth inner surface 14D, and the second bottom surface 142. The first space 131 is deeper than the second space 132.

The two first battery mounts 81 are located on the first inner surface 14A facing the first space 131 of the battery compartment 13. One second battery mount 82 is located on the second inner surface 14B facing the first space 131 of the battery compartment 13. The other second battery mount 82 is located on the fourth inner surface 14D facing the first space 131 of the battery compartment 13.

The second inner surface 14B is located on the right of the first inner surface 14A. The first inner surface 14A has its right end meeting the front end of the second inner surface 14B. The first inner surface 14A and the second inner surface 14B are substantially orthogonal to each other.

The fourth inner surface 14D is located on the left of the first inner surface 14A. The first inner surface 14A has its left end meeting the front end of the fourth inner surface 14D. The first inner surface 14A and the fourth inner surface 14D are substantially orthogonal to each other.

The first battery 61 attached to the first battery mount 81 is located in the first space 131 of the battery compartment 13. The second battery 62 attached to the second battery mount 82 is located in the first space 131 of the battery compartment 13.

As shown in FIGS. 4, 8, and 9, the battery compartment 13 accommodates an output terminal 19 on the second inner surface 14B of the battery compartment 13. The output terminal 19 in the embodiment is located on the second inner surface 14B of the second space 132.

The output terminal 19 in the embodiment is a universal serial bus (USB) terminal. The output terminal 19 is used to output power from at least one of the first battery 61 or the second battery 62. When, for example, an electronic device such as a mobile terminal includes a rechargeable battery, the cooler 1 can charge the rechargeable battery in the electronic device. The electronic device and the output terminal 19 are connected to each other with a USB cable. The rechargeable battery in the electronic device is charged with power output from at least one of the first battery 61 or the second battery 62 through the output terminal 19. The user of the cooler 1 can place the electronic device on the second bottom surface 142 during charging.

Cooling Unit

Figure 10:
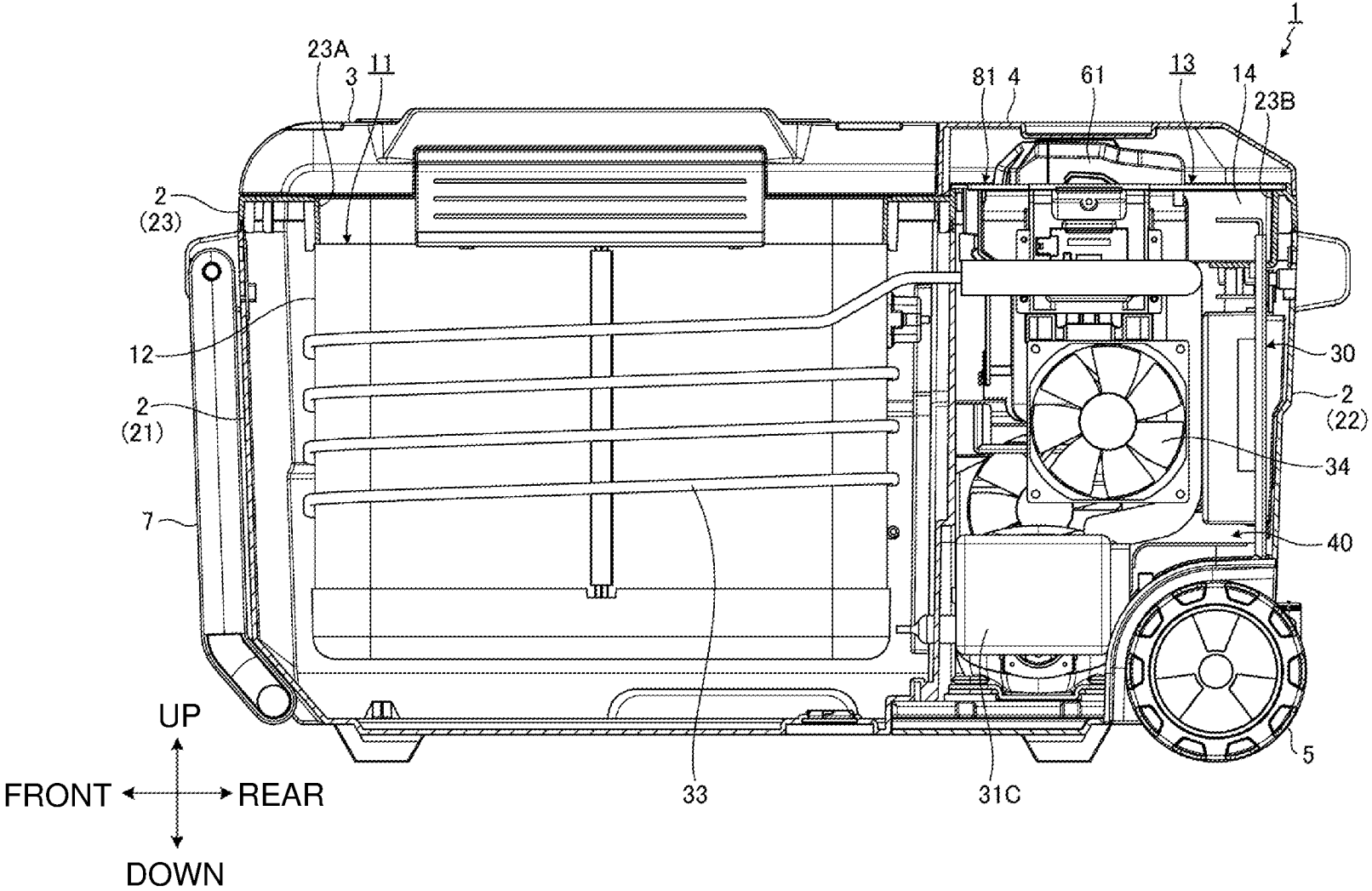
FIG. 10 is a left side view of the cooler according to the embodiment partially being cut away.
Figure 11:
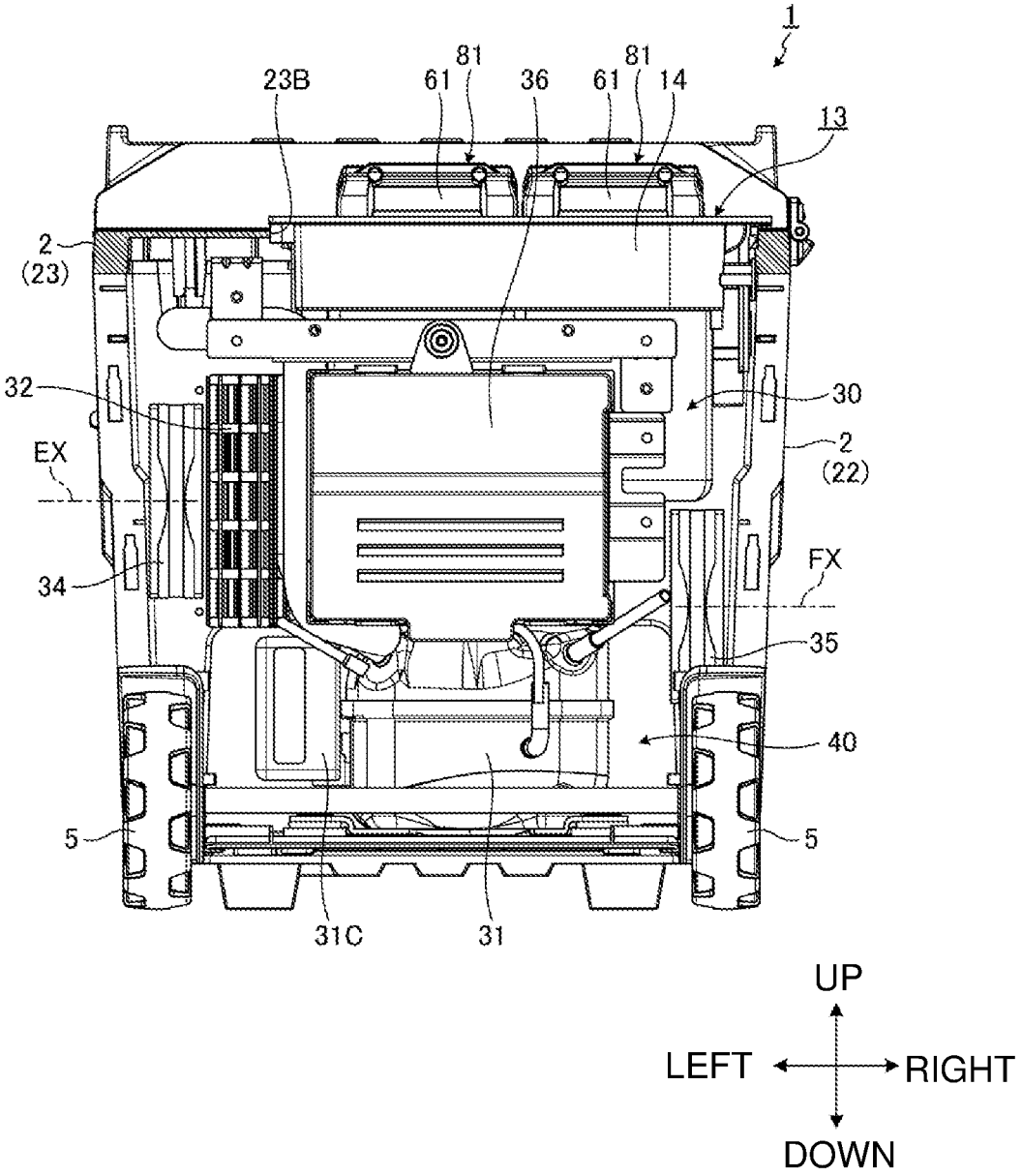
FIG. 11 is a rear view of the cooler according to the embodiment partially being cut away.
Figure 12:
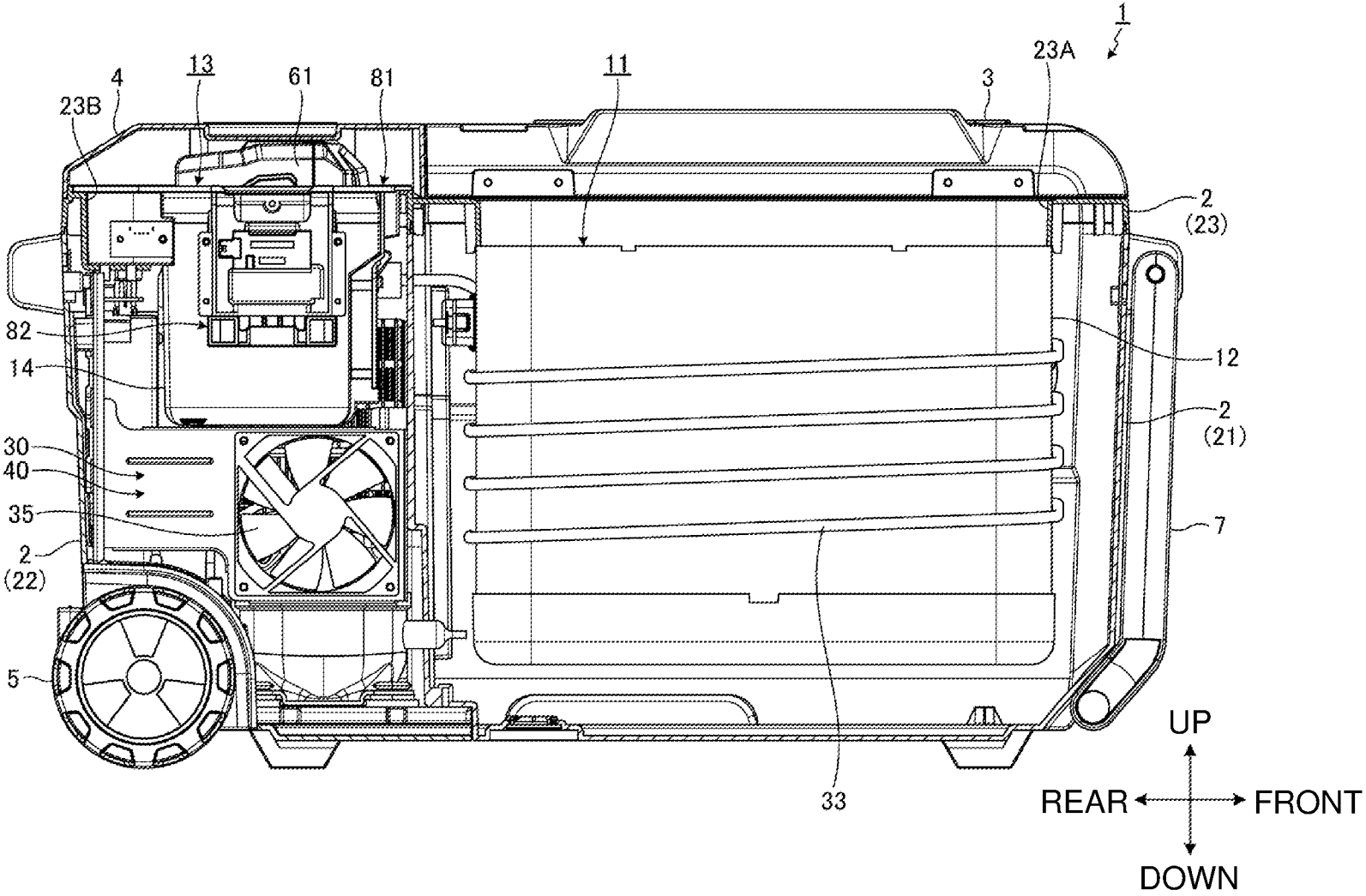
FIG. 12 is a right side view of the cooler according to the embodiment partially being cut away.

FIG. 10 is a left side view of the cooler 1 according to the embodiment partially being cut away. FIG. 11 is a rear view of the cooler 1 according to the embodiment partially being cut away. FIG. 12 is a right side view of the cooler 1 according to the embodiment partially being cut away.

The cooler 1 includes a cooling unit 30 for cooling the main container 12. The cooling unit 30 includes a compressor 31, a condenser 32, an expansion valve (not shown), and an evaporator 33, forming a refrigerant circulation system.

The compressor 31 compresses a refrigerant gas. The compressor 31 is controlled by a compressor controller 31C. A high-temperature, high-pressure refrigerant gas compressed by the compressor 31 is fed to the condenser 32. The condenser 32 then cools and condenses the refrigerant gas fed from the compressor 31 to produce a refrigerant liquid. The refrigerant liquid produced in the condenser 32 is fed to the expansion valve. The expansion valve depressurizes the refrigerant liquid to lower the boiling point of the refrigerant liquid. The refrigerant liquid with a lower pressure after flowing through the expansion valve is fed to the evaporator 33. The evaporator 33 vaporizes the refrigerant liquid fed from the expansion valve and cools the main container 12 with the heat of vaporization. The refrigerant gas flowing through the evaporator 33 then returns to the compressor 31.

The evaporator 33 is located on the main container 12. The evaporator 33 includes a pipe placed or wound around the main container 12 in contact with the outer surface of the main container 12.

The compressor 31 and the condenser 32 are located adjacent to the main container 12. The compressor 31 and the condenser 32 in the embodiment are located rearward from the main container 12.

The first battery mounts 81 and the second battery mounts 82 are located rearward from the main container 12 and above the compressor 31 and the condenser 32.

A machinery compartment 40 accommodating the compressor 31 and the condenser 32 is located below the battery container 14. The machinery compartment 40 is defined by the rear housing 22.

More specifically, the machinery compartment 40 is located below the battery compartment 13 in the embodiment. The battery compartment 13 accommodates the first battery mounts 81 and the second battery mounts 82. The machinery compartment 40 accommodates the compressor 31 and the condenser 32.

The compressor 31 and the condenser 32 are at different positions in the vertical direction. In the machinery compartment 40, the compressor 31 is located below the condenser 32. The condenser 32 is leftward from the center of the machinery compartment 40, and the compressor 31 is partially at the center of the machinery compartment 40 in the lateral direction.

The cooling unit 30 includes an intake fan 34, an exhaust fan 35, and a controller 36.

The machinery compartment 40 accommodates the intake fan 34, the exhaust fan 35, and the controller 36. In the machinery compartment 40, the compressor 31 is located below the intake fan 34, the exhaust fan 35, and the controller 36. The intake fan 34, at least a part of the condenser 32, at least a part of the exhaust fan 35, and at least a part of the controller 36 are aligned in the vertical direction. A rotation axis FX of the exhaust fan 35 in the embodiment is located below a rotation axis EX of the intake fan 34.

The intake fan 34 rotates about the rotation axis EX extending laterally. The intake fan 34 is located in a left portion of the machinery compartment 40. The intake fan 34 rotates to cause air outside the housing 2 to flow into the machinery compartment 40. An intake motor (not shown) is joined to the intake fan 34. The intake fan 34 rotates with a rotational force generated by the intake motor. As shown in FIG. 1 and other figures, the rear housing 22 has an inlet 24 in its left portion. The intake fan 34 rotates to cause air outside the housing 2 to flow into the machinery compartment 40 through the inlet 24.

The exhaust fan 35 rotates about the rotation axis FX extending laterally. The exhaust fan 35 is located in a right portion of the machinery compartment 40. The exhaust fan 35 rotates to cause air in the machinery compartment 40 to flow out of the housing 2. An exhaust motor (not shown) is joined to the exhaust fan 35. The exhaust fan 35 rotates with a rotational force generated by the exhaust motor. As shown in FIG. 2 and other figures, the rear housing 22 has an outlet 25 in its right portion. The exhaust fan 35 rotates to cause air in the machinery compartment 40 to flow out of the housing 2 through the outlet 25.

The controller 36 controls the cooler 1. The controller 36 controls at least the cooling unit 30. The controller 36 includes a circuit board on which multiple electronic components are mounted. Examples of the electronic components mounted on the board include a processor such as a central processing unit (CPU), a nonvolatile memory such as a read-only memory (ROM) or a storage device, a volatile memory such as a random-access memory (RAM), a transistor, and a resistor.

The intake fan 34 is located leftward from the condenser 32 in the lateral direction. The intake fan 34 is located between the inlet 24 and the condenser 32 in the lateral direction. The intake fan 34 faces the condenser 32.

The condenser 32 is located leftward from the controller 36 in the lateral direction. The exhaust fan 35 is located rightward from the controller 36 in the lateral direction. The exhaust fan 35 is located between the controller 36 and the outlet 25 in the lateral direction.

The intake fan 34 feeds air to the condenser 32 and to the controller 36. The refrigerant gas in the condenser 32 is then cooled and changes to a refrigerant liquid. The controller 36 is thus cooled.

The cooler 1 according to the embodiment has both cooling capabilities and warming capabilities. A heating wire (not shown) is placed around the main container 12. Products stored in the main container 12 are kept warm with heat generated by the heating wire.

Battery Attachment Patterns

FIGS. 13 to 16 are top views of the battery compartment 13 in the embodiment.

The first battery mounts 81 are located on the first inner surface 14A (first surface) facing the battery compartment 13. The two first battery mounts 81 are arranged laterally on the first inner surface 14A in the embodiment.

The second battery mounts 82 are located on the respective second inner surface 14B (second surface) and the fourth inner surface 14D (second surface) facing the battery compartment 13. The first inner surface 14A and the second inner surface 14B are substantially orthogonal to each other. The first inner surface 14A and the fourth inner surface 14D are substantially orthogonal to each other.

Of the two first battery mounts 81, the first battery mount 81 arranged on the right is hereafter referred to as a first battery mount 81R, and the first battery mount 81 arranged on the left is referred to as a first battery mount 81L for convenience. Of the two second battery mounts 82, the second battery mount 82 located on the second inner surface 14B is referred to as a second battery mount 82R, and the second battery mount 82 located on the fourth inner surface 14D is referred to as a second battery mount 82L for convenience.

In the embodiment, a battery mount set includes one first battery mount 81 and one second battery mount 82. In the embodiment, a first battery mount set includes the first battery mount 81R and the second battery mount 82R. A second battery mount set includes the first battery mount 81L and the second battery mount 82L.

The first battery mount 81R serves as the first battery mount 81 in the first battery mount set. The second battery mount 82R serves as the second battery mount 82 in the first battery mount set.

The first battery mount 81L serves as the first battery mount 81 in the second battery mount set. The second battery mount 82L serves as the second battery mount 82 in the second battery mount set.

More specifically, the first battery mount 81R in the first battery mount set and the first battery mount 81L in the second battery mount set are located on the first inner surface 14A. The second battery mount 82R in the first battery mount set is located on the second inner surface 14B. The second battery mount 82L in the second battery mount set is located on the fourth inner surface 14D.

In each battery mount set, the first battery mount 81 and the second battery mount 82 are positioned relative to each other in accordance with the profiles and dimensions of the first battery 61 and the second battery 62 to cause the second battery 62 to be unattachable to the second battery mount 82 when the first battery 61 is attached to the first battery mount 81 and to cause the first battery 61 to be unattachable to the first battery mount 81 when the second battery 62 is attached to the second battery mount 82.

More specifically, in the first battery mount set, the first battery mount 81R and the second battery mount 82R are positioned relative to each other in accordance with the profiles and dimensions of the first battery 61 and the second battery 62 to cause the second battery 62 to be unattachable to the second battery mount 82R when the first battery 61 is attached to the first battery mount 81R and to cause the first battery 61 to be unattachable to the first battery mount 81R when the second battery 62 is attached to the second battery mount 82R.

In the second battery mount set, the first battery mount 81L and the second battery mount 82L are positioned relative to each other in accordance with the profiles and dimensions of the first battery 61 and the second battery 62 to cause the second battery 62 to be unattachable to the second battery mount 82L when the first battery 61 is attached to the first battery mount 81L and to cause the first battery 61 to be unattachable to the first battery mount 81L when the second battery 62 is attached to the second battery mount 82L.

Figure 13:
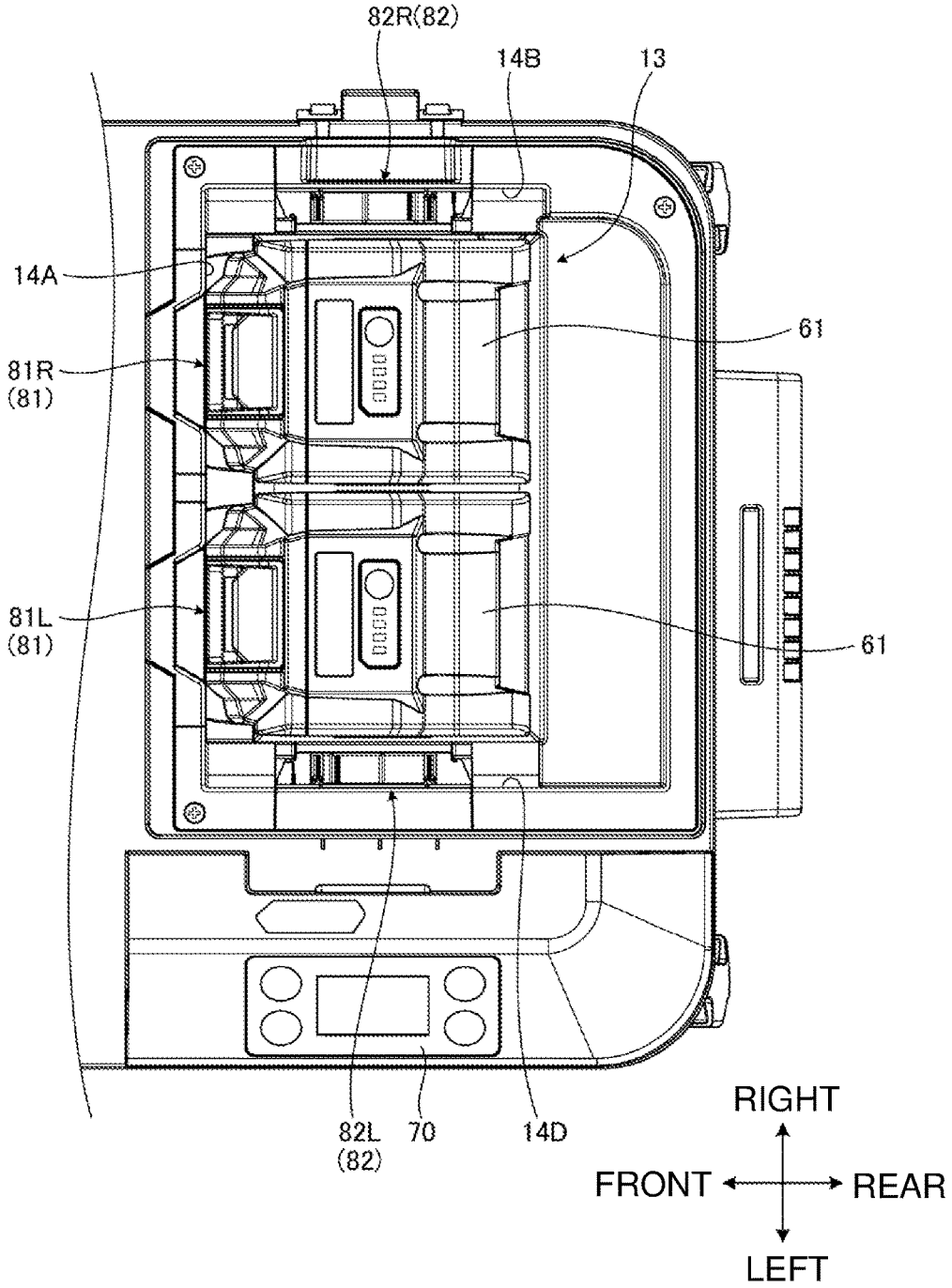
FIG. 13 is a top view of a battery compartment in the embodiment.

As shown in FIG. 13, the first batteries 61 are attachable to each of the first battery mounts 81R and 81L when the second batteries 62 are unattached to each of the second battery mounts 82R and 82L. In this case, the second batteries 62 are unattachable to each of the second battery mounts 82R and 82L. When the first battery 61 is attached to the first battery mount 81R, the second battery 62 is blocked by the first battery 61 and is unattachable to the second battery mount 82R. When the first battery 61 is attached to the first battery mount 81L, the second battery 62 is blocked by the first battery 61 and is unattachable to the second battery mount 82L.

Figure 14:
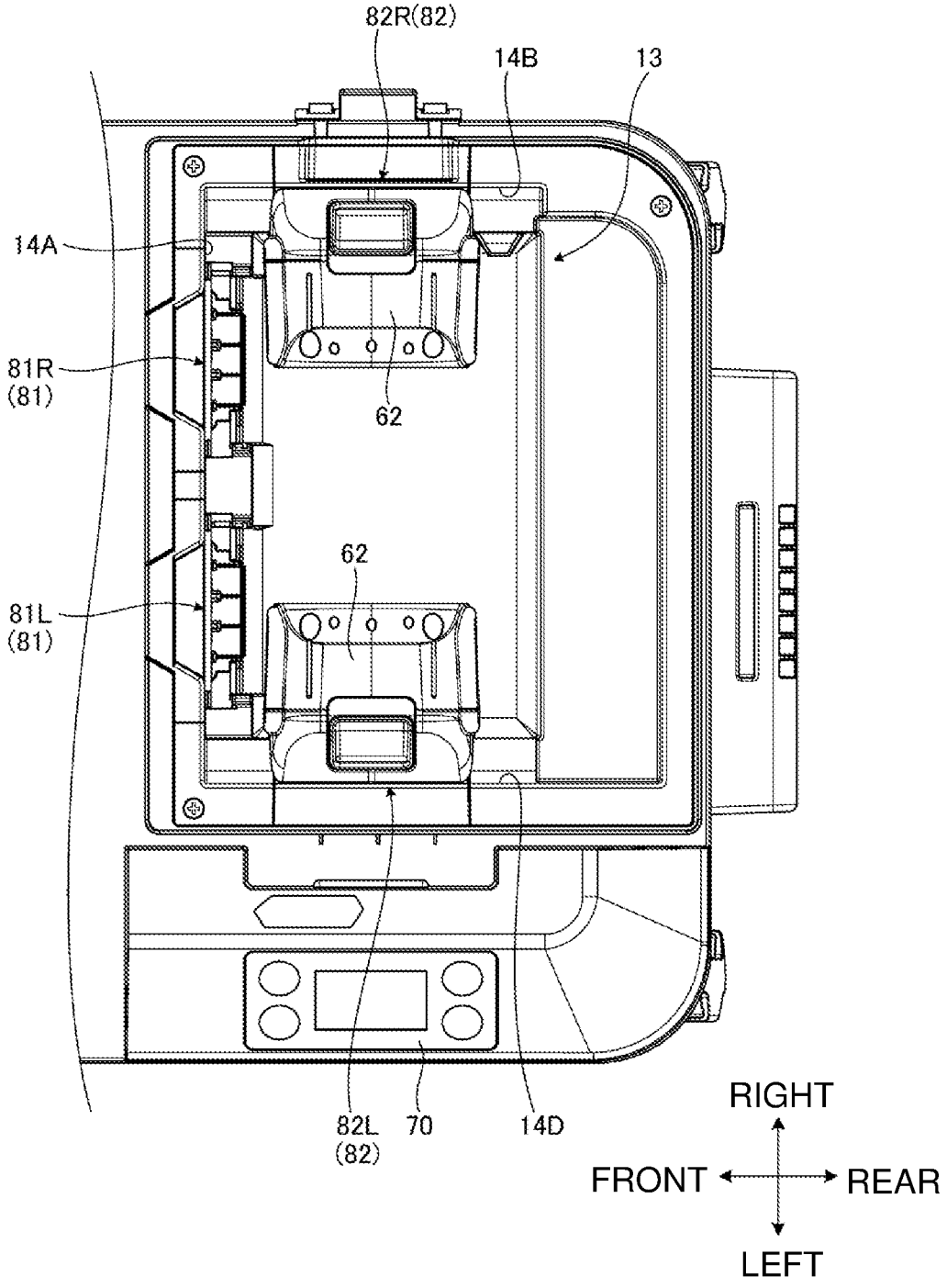
FIG. 14 is a top view of the battery compartment in the embodiment.

As shown in FIG. 14, the second batteries 62 are attachable to each of the second battery mounts 82R and 82L when the first batteries 61 are unattached to each of the first battery mounts 81R and 81L. In this case, the first batteries 61 are unattachable to each of the first battery mounts 81R and 81L. When the second battery 62 is attached to the second battery mount 82R, the first battery 61 is blocked by the second battery 62 and is unattachable to the first battery mount 81R. When the second battery 62 is attached to the second battery mount 82L, the first battery 61 is blocked by the second battery 62 and is unattachable to the first battery mount 81L.

Figure 15:
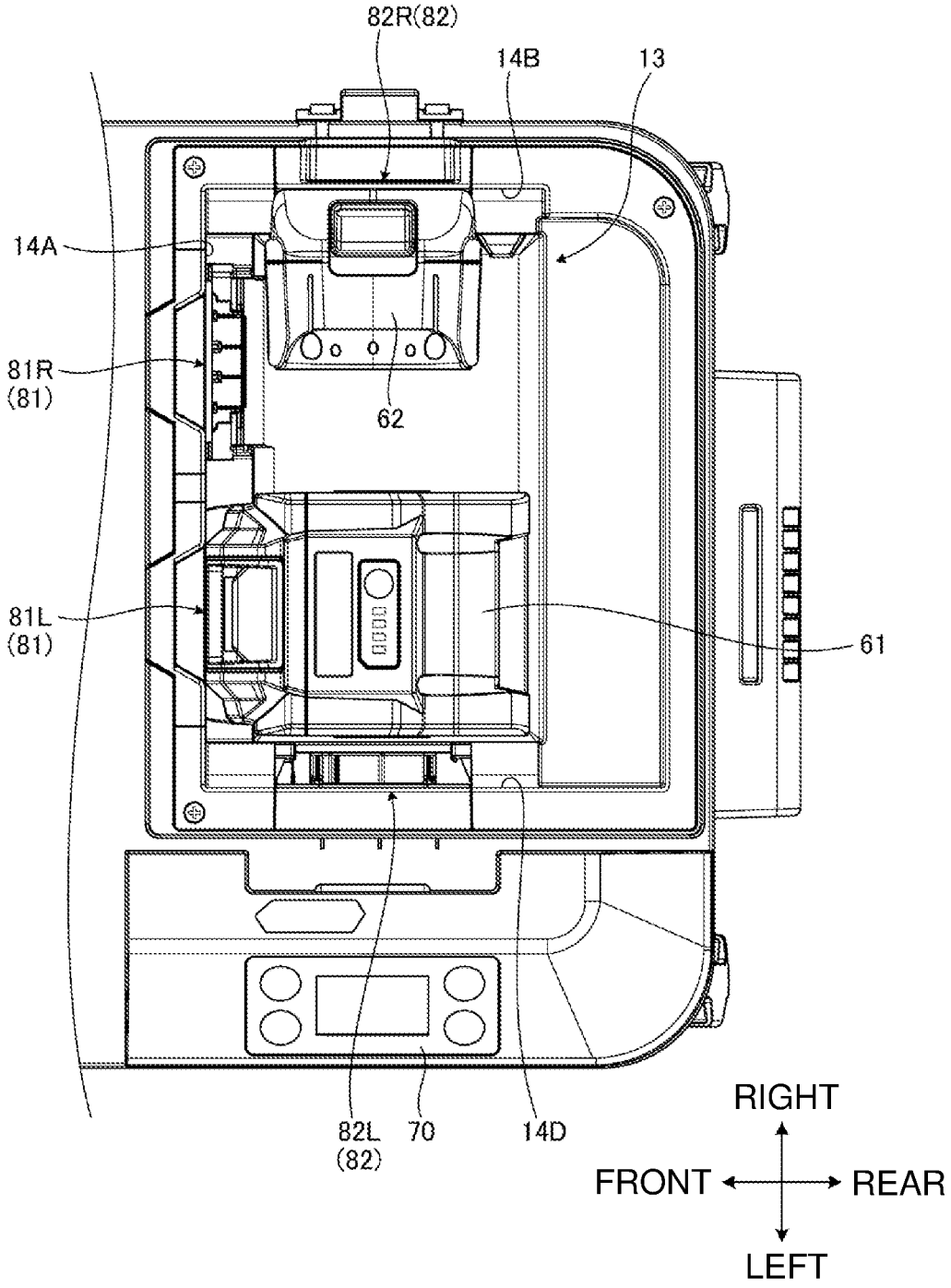
FIG. 15 is a top view of the battery compartment in the embodiment.

As shown in FIG. 15, the second battery 62 is attachable to the second battery mount 82R and the first battery 61 is attachable to the first battery mount 81L when another first battery 61 is unattached to the first battery mount 81R and another second battery 62 is unattached to the second battery mount 82L. In this case, the other first battery 61 is unattachable to the first battery mount 81R, and the other second battery 62 is unattachable to the second battery mount 82L.

Figure 16:
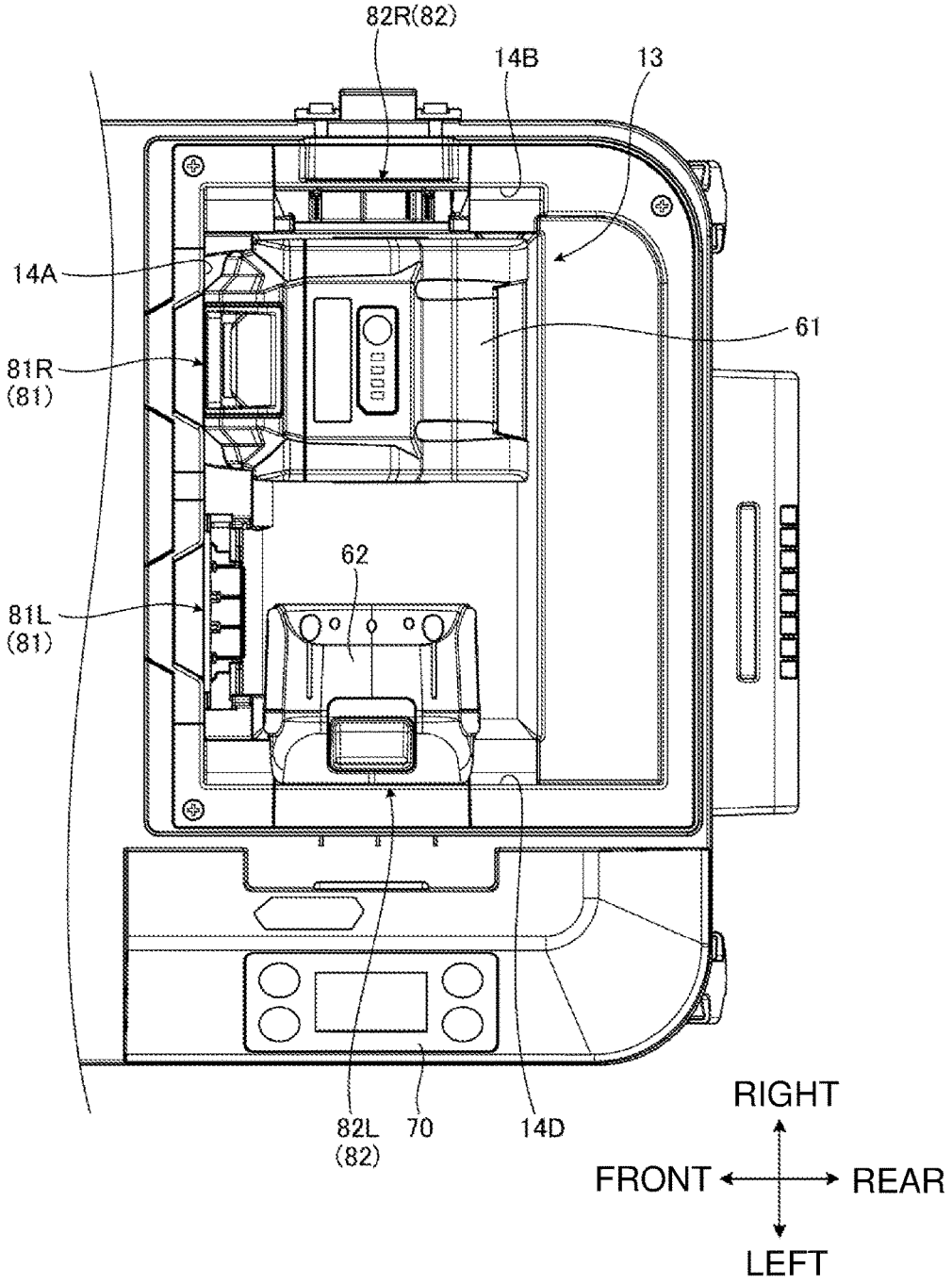
FIG. 16 is a top view of the battery compartment in the embodiment.

As shown in FIG. 16, the second battery 62 is attachable to the second battery mount 82L and the first battery 61 is attachable to the first battery mount 81R when another first battery 61 is unattached to the first battery mount 81L and another second battery 62 is unattached to the second battery mount 82R. In this case, the other first battery 61 is unattachable to the first battery mount 81L, and the other second battery 62 is unattachable to the second battery mount 82R.

Figure 17:
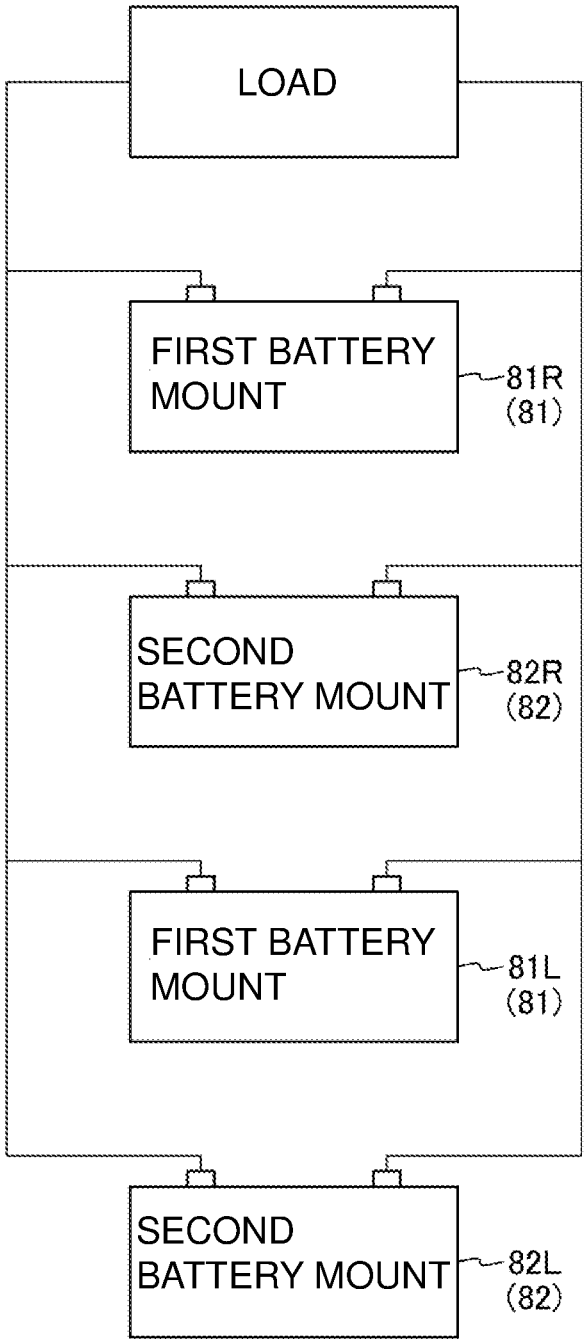
FIG. 17 is a schematic diagram of the first battery mount and the second battery mount in the embodiment.

FIG. 17 is a schematic diagram of the first battery mounts 81 and the second battery mounts 82 in the embodiment. As shown in FIG. 17, the first battery mount 81R in the first battery mount set, the second battery mount 82R in the first battery mount set, the first battery mount 81L in the second battery mount set, and the second battery mount 82L in the second battery mount set are connected in parallel.

As shown in FIGS. 13 to 16, two batteries (61, 62) attached to the cooler 1 at the same time are electrically connected in parallel. The electronic devices (loads) installed on the cooler 1 are operable using the power from the two batteries (61, 62). The two batteries (61, 62) are connected in parallel. The cooler 1 is thus less likely to shorten the operable time.

The two batteries (61, 62) are electrically connected in parallel. The electronic devices (loads) installed on the cooler 1 are thus operable with power supplied from a single battery attached to the cooler 1.

Operation Panel

Figure 18:
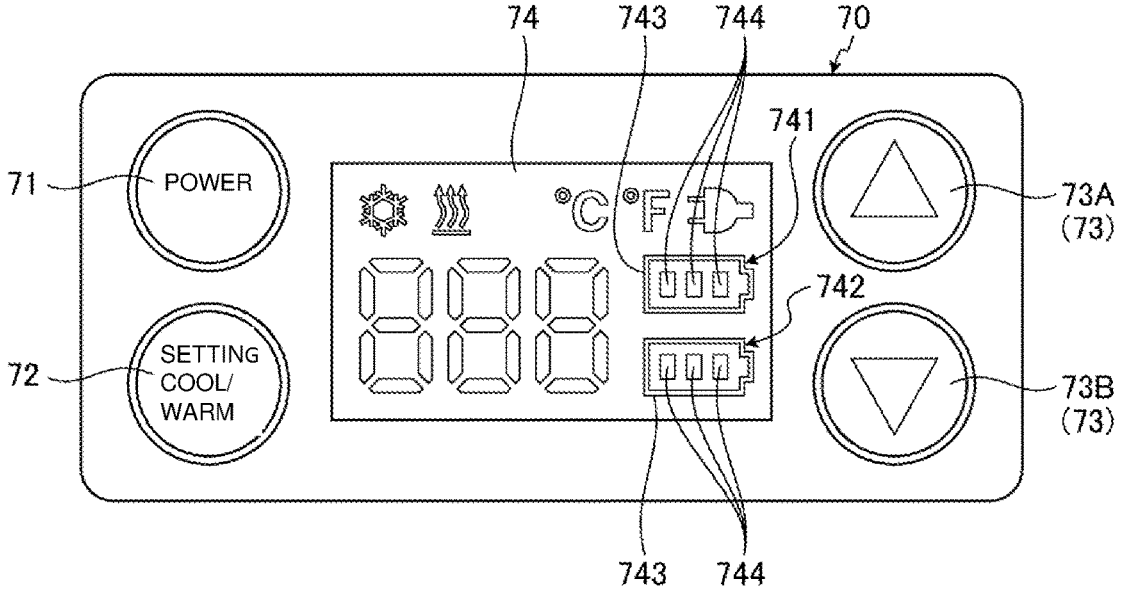
FIG. 18 is a diagram showing an operation panel in the embodiment.

FIG. 18 shows an operation panel 70 in the embodiment. The cooler 1 includes the operation panel 70. As shown in FIGS. 1 and 3, the operation panel 70 is located in a left portion of the battery compartment cover 4 and above the left surface 2C of the rear housing 22. The operation panel 70 includes a power button 71, a mode switch button 72, temperature setting buttons 73, and a display 74.

The user of the cooler 1 operates the power button 71, the mode switch button 72, and the temperature setting buttons 73. The power button 71 is operable to supply power from the batteries (61, 62) to the cooler 1 to activate the cooler 1. The mode switch button 72 is operable to switch the operation mode between the cooling mode and the warming mode. The temperature setting buttons 73 are operable to set the target temperature of the main container 12. The temperature setting buttons 73 include a first temperature setting button 73A and a second temperature setting button 73B. The first temperature setting button 73A is operable to increase the target temperature of the main container 12. The second temperature setting button 73B is operable to decrease the target temperature of the main container 12.

The display 74 includes, for example, a liquid crystal display panel. The display 74 displays the operating status of the power button 71, the mode switch button 72, and the temperature setting buttons 73.

The display 74 also displays the remaining battery level of at least one of the first battery 61 or the second battery 62.

The battery (61, 62) being attached to either of the two battery mounts (81R, 82R) in the first battery mount set is hereafter referred to as the battery being attached to the first battery mount set for convenience. The battery (61, 62) being attached to either of the two battery mounts (81L, 82L) in the second battery mount set is referred to as the battery being attached to the second battery mount set for convenience.

The display 74 includes a first display section 741 and a second display section 742. The first display section 741 displays the status of the first battery mount set. The second display section 742 displays the status of the second battery mount set. The first display section 741 and the second display section 742 each display a frame-shaped symbol image 743 and multiple rectangular symbol images 744. The symbol images 744 appear inside the symbol image 743.

The first display section 741 displays the remaining battery level of one of the first battery 61 or the second battery 62 attached to the first battery mount set. The second display section 742 displays the remaining battery level of one of the first battery 61 or the second battery 62 attached to the second battery mount set. More symbol images 744 appear as the remaining battery level of the battery (61, 62) is higher. Fewer symbol images 744 appear as the remaining battery level of the battery (61, 62) is lower.

The first display section 741 displays the remaining battery level of the first battery 61 when the first battery 61 is attached to the first battery mount 81R in the first battery mount set. The first display section 741 displays the remaining battery level of the second battery 62 when the second battery 62 is attached to the second battery mount 82R in the first battery mount set.

The second display section 742 displays the remaining battery level of the first battery 61 when the first battery 61 is attached to the first battery mount 81L in the second battery mount set. The second display section 742 displays the remaining battery level of the second battery 62 when the second battery 62 is attached to the second battery mount 82L in the second battery mount set.

The display 74 also indicates whether the first battery 61 and the second battery 62 are being discharged. The battery (61, 62) being discharged includes the battery (61, 62) supplying power to the cooler 1. The first display section 741 indicates whether the battery (61, 62) attached to the first battery mount set is being discharged. The second display section 742 indicates whether the battery (61, 62) attached to the second battery mount set is being discharged. For the battery (61, 62) being discharged, at least the symbol image 743 appears.

Figure 19:
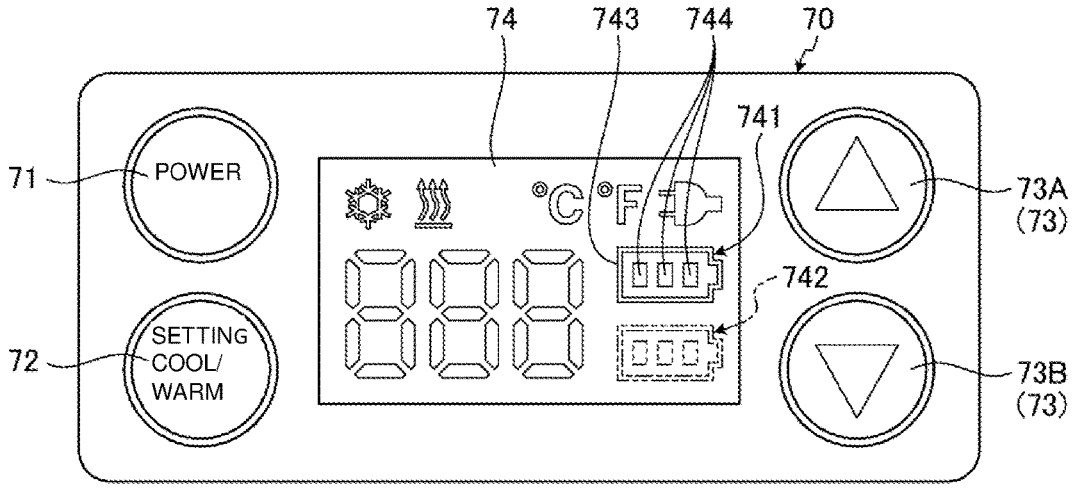
FIG. 19 is a diagram showing an example display on a display in the embodiment

FIG. 19 shows an example display on the display 74 in the embodiment. FIG. 19 shows a display indicating the status of the battery (61, 62) attached to the first battery mount set being discharged with another battery (61, 62) unattached to the second battery mount set. The display 74 displays, in the first display section 741, the symbol image 743 indicating that the battery (61, 62) attached to the first battery mount set is being discharged. The display 74 does not display the symbol image 743 and the symbol image 744 in the second display section 742 because no battery (61, 62) is attached to the second battery mount set.

Although not shown, the display 74 displays at least the symbol image 743 in the second display section 742 and does not display the symbol image 743 and the symbol image 744 in the first display section 741 when no battery (61, 62) is attached to the first battery mount set and the battery (61, 62) attached to the second battery mount set is being discharged.

Method of Use

A method of using the cooler 1 according to the embodiment will now be described. To attach the battery (61, 62) to the battery mount (81, 82), the user of the cooler 1 pivots the battery compartment cover 4 to uncover the opening 16 of the battery compartment 13. In this state, the battery (61, 62) is slidable downward along the battery mount (81, 82). The battery (61, 62) is thus attached to the battery mount (81, 82). The power button 71 is operable to supply power from the battery (61, 62) to the cooler 1 to activate the cooler 1. The mode switch button 72 is operable to switch to the cooling mode to activate the cooling unit 30. Products stored in the refrigeration compartment 11 are kept cold.

To charge the rechargeable battery in the electronic device, the user of the cooler 1 connects the electronic device to the output terminal 19 with the USB cable. The rechargeable battery in the electronic device is charged with power output from the battery (61, 62) through the output terminal 19.

To move the cooler 1, the user of the cooler 1 grips the handle portion 7B of the carrier handle 7 moved to the in-use position Pb, and places the cooler 1 tilted with the legs 50 away from the ground and the casters 5 in contact with the ground. The user of the cooler 1 can then move the tilted cooler 1 while walking. The user of the cooler 1 may also grip the pair of handles 6 and lift the cooler 1.

As described above, in the embodiment, the cooler 1 includes the main container 12 including the refrigeration compartment 11 and the battery mount set including the first battery mount 81 and the second battery mount 82. In the battery mount set, the first battery mount 81 and the second battery mount 82 are positioned relative to each other to cause the second battery 62 to be unattachable to the second battery mount 82 when the first battery 61 is attached to the first battery mount 81 and to cause the first battery 61 to be unattachable to the first battery mount 81 when the second battery 62 is attached to the second battery mount 82.

This reduces size increase in the cooler 1. When the user of the cooler 1 has the first battery 61 and the second battery 62, the first battery 61 and the second battery 62 can be used effectively. For example, when the first battery 61 is used as a power supply for the cooler 1 and the remaining battery level of the first battery 61 decreases, the first battery 61 is detached from the first battery mount 81 and the second battery 62 is attached to the second battery mount 82. This allows the cooler 1 to continue operating.

The first battery mount 81 and the second battery mount 82 have different interfaces.

The first battery 61 and the second battery 62 of different types can be used effectively.

The first battery mount 81 receives the first battery 61 with a first rated voltage. The second battery mount 82 receives the second battery 62 with a second rated voltage different from the first rated voltage.

The first battery 61 and the second battery 62 with different rated voltages can be used effectively.

The first battery mount 81 receives the first battery 61 with first outer dimensions. The second battery mount 82 receives the second battery 62 with second outer dimensions different from the first outer dimensions.

The first battery 61 and the second battery 62 with different outer dimensions can be used effectively.

The first battery mount 81 and the second battery mount 82 are connected in parallel.

The cooler 1 can be operable without the operable time being shortened. The cooler 1 is operable with power supplied from a single battery when the single battery is attached to either of the two battery mounts (81, 82).

The cooler 1 includes the battery container 14 including the battery compartment 13. The first battery mount 81 is located on the first inner surface 14A (first surface) facing the battery compartment 13. The second battery mount 82 is located on at least one of the second inner surface 14B (second surface) or the fourth inner surface 14D (second surface) facing the battery compartment 13.

The first and second battery mounts 81 and 82 are thus protected by the battery container 14.

The first inner surface 14A (first surface) receiving the first battery mount 81 and the second inner surface 14B (second surface) receiving the second battery mount 82 are orthogonal to each other. The first inner surface 14A (first surface) receiving the first battery mount 81 and the fourth inner surface 14D (second surface) receiving the second battery mount 82 are orthogonal to each other.

This reduces size increase in the battery container 14. The first battery mount 81 and the second battery mount 82 are positioned relative to each other to cause the second battery 62 to be unattachable to the second battery mount 82 when the first battery 61 is attached to the first battery mount 81 and to cause the first battery 61 to be unattachable to the first battery mount 81 when the second battery 62 is attached to the second battery mount 82.

The battery mount set includes the first battery mount set and the second battery mount set.

This allows the battery (61, 62) to be attachable to the battery mount (81L, 82L) in the second battery mount set with the battery (61, 62) being attached to the battery mount (81R, 82R) in the first battery mount set.

The second inner surface 14B (second surface) is located adjacent to a first end (right end) of the first inner surface 14A (first surface). The fourth inner surface 14D (second surface) is located adjacent to a second end (left end) of the first inner surface 14A (first surface). The first battery mount 81R in the first battery mount set and the first battery mount 81L in the second battery mount set are located on the first inner surface 14A (first surface). The second battery mount 82R in the first battery mount set is located on the second inner surface 14B (second surface) adjacent to the first end. The second battery mount 82L in the second battery mount set is located on the fourth inner surface 14D (second surface) adjacent to the second end.

This reduces size increase in the cooler 1 in which the first battery mount 81 (81R, 81L) and the second battery mount 82 (82R, 82L) are properly positioned relative to each other.

The first batteries 61 are attachable to the first battery mount 81R in the first battery mount set and to the first battery mount 81L in the second battery mount set when the second batteries 62 are unattached to the second battery mount 82R in the first battery mount set and to the second battery mount 82L in the second battery mount set.

The two first batteries 61 can be used effectively. The cooler 1 can also be operable without the operable time being shortened.

The second batteries 62 are attachable to the second battery mount 82R in the first battery mount set and to the second battery mount 82L in the second battery mount set when the first batteries 61 are unattached to the first battery mount 81R in the first battery mount set and to the first battery mount 81L in the second battery mount set.

The two second batteries 62 can be used effectively. The cooler 1 can also be operable without the operable time being shortened.

The second battery 62 is attachable to the second battery mount 82R in the first battery mount set and the first battery 61 is attachable to the first battery mount 81L in the second battery mount set when another first battery 61 is unattached to the first battery mount 81R in the first battery mount set and another second battery 62 is unattached to the second battery mount 82L in the second battery mount set. The second battery 62 is attachable to the second battery mount 82L in the second battery mount set and the first battery 61 is attachable to the first battery mount 81R in the first battery mount set when another first battery 61 is unattached to the first battery mount 81L in the second battery mount set and another second battery 62 is unattached to the second battery mount 82R in the first battery mount set.

The first battery 61 and the second battery 62 can be used effectively. The cooler 1 can also be operable without the operable time being shortened.

The cooler 1 includes the display 74 that displays the remaining battery level of at least one of the first battery 61 or the second battery 62.

The user of the cooler 1 can thus view the remaining battery level of at least one of the first battery 61 or the second battery 62.

The display 74 includes the first display section 741 that displays the remaining battery level of one of the first battery 61 or the second battery 62 attached to the first battery mount set, and the second display section 742 that displays the remaining battery level of one of the first battery 61 or the second battery 62 attached to the second battery mount set.

The single first display section 741 is thus used to display the remaining battery level of the first battery 61 or the second battery 62 attached to the first battery mount set. The single second display section 742 is used to display the remaining battery level of the first battery 61 or the second battery 62 attached to the second battery mount set. This reduces size increase in the display 74.

The first display section 741 displays the remaining battery level of the first battery 61 attached to the first battery mount set, or displays the remaining battery level of the second battery 62 attached to the first battery mount set. The second display section 742 displays the remaining battery level of the first battery 61 attached to the second battery mount set, or displays the remaining battery level of the second battery 62 attached to the second battery mount set.

This allows the user of the cooler 1 to view the remaining battery level of the battery (61, 62) attached to the first battery mount set and the remaining battery level of the battery (61, 62) attached to the second battery mount set.

The display 74 indicates whether the first battery 61 and the second battery 62 are being discharged.

The display 74 thus can indicate whether the battery (61, 62) is attached to the first battery mount set and whether the battery (61, 62) is attached to the second battery mount set. The user of the cooler 1 can visually determine whether the battery (61, 62) is attached to the first battery mount set and whether the battery (61, 62) is attached to the second battery mount set.

The first battery mount 81R in the first battery mount set, the second battery mount 82R in the first battery mount set, the first battery mount 81L in the second battery mount set, and the second battery mount 82L in the second battery mount set are connected in parallel.

The cooler 1 can be operable without the operable time being shortened. The cooler 1 is operable with power supplied from a single battery attached to any one of the four battery mounts (81R, 82R, 81L, 82L).

Other Embodiments

In the above embodiment, each battery mount set may include the first battery mount (81) to which the first battery (61) is attachable, the second battery mount (82) to which the second battery (62) is attachable, and a third battery mount to which a third battery is attachable. Each battery mount set may include four or more battery mounts. Multiple types of batteries corresponding to the number of battery mounts in each battery mount set may be attachable to the battery mounts. In a battery mount set including the first battery mount, the second battery mount, and the third battery mount, the first battery mount, the second battery mount, and the third battery mount may be positioned relative to one another to cause the second and third batteries to be unattachable to the second and third battery mounts when the first battery is attached to the first battery mount, to cause the third and first batteries to be unattachable to the third and first battery mounts when the second battery is attached to the second battery mount, and to cause the first and second batteries to be unattachable to the first and second battery mounts when the third battery is attached to the third battery mount. The first battery may have a rated voltage of 36 V, the second battery may have a rated voltage of 18 V or 14.4 V, and the third battery may have a rated voltage of 10.8 V.

In the above embodiment, the output terminal 19 may output data stored in a memory. As described above, the controller 36 may include the memory including a nonvolatile memory or a volatile memory. The data stored in the memory may be output through the output terminal 19. When the memory stores, for example, data about the operation history of the cooler 1, the operation history data may be output to a personal computer through the output terminal 19 and the USB cable. The user or maintenance personnel of the cooler 1 may use the operation history data for maintenance of the cooler 1.

REFERENCE SIGNS LIST

1 cooler
2 housing
2A front surface
2B rear surface
2C left surface
2D right surface
2E lower surface
3 refrigeration compartment cover
3C seal
3L latch assembly
4 battery compartment cover
4L latch assembly
4R recess
5 caster
6 handle
7 carrier handle
7A arm
7B handle portion
7C connector
8 hinge assembly
9 hinge assembly
10 hinge assembly
11 refrigeration compartment
12 main container
12A first inner surface
12B second inner surface
12C third inner surface
12D fourth inner surface
12E bottom surface
13 battery compartment
14 battery container
14A first inner surface
14B second inner surface

14C third inner surface
14D fourth inner surface
14E bottom surface
14F step surface
15 opening
16 opening
19 output terminal
21 front housing
22 rear housing
23 frame housing
23A first opening
23B second opening
24 inlet
25 outlet
30 cooling unit
31 compressor
31C compressor controller
32 condenser
33 evaporator
34 intake fan
35 exhaust fan
36 controller
40 machinery compartment
50 leg
51 power jack
52 connector plug
53 bottle opener
61 first battery
61A mount surface
61B housing
61C slide
61D protrusion
61E release button
61F power terminal
62 second battery
62A mount surface
62B housing
62C slide
62D protrusion
62E release button
62F power terminal
70 operation panel
71 power button
72 mode switch button
73 temperature setting button
73A first temperature setting button
73B second temperature setting button
74 display
81 first battery mount
81A mount surface
81B guide
81C lock slot
81D power terminal
81L first battery mount
81R first battery mount
82 second battery mount
82A mount surface
82B guide
82C lock slot
82D power terminal
82L second battery mount
82R second battery mount
131 first space
132 second space
141 first bottom surface
142 second bottom surface
741 first display section
742 second display section
743 symbol image
744 symbol image
AX hinge axis
BX hinge axis
CX rotation axis
DX hinge axis
EX rotation axis
FX rotation axis
Pa retracted position
Pb in-use position

What is claimed is:

1. A cooler, comprising:

a main container including a refrigeration compartment; and a battery mount set including a first battery mount to which a first battery is attachable and a second battery mount to which a second battery, different in type and size from the first battery, is attachable, wherein the first battery mount and the second battery mount are positioned relative to each other and configured such that (i) the second battery cannot be attached to the second battery mount when the first battery is attached to the first battery mount and (ii) the first battery cannot be attached to the first battery mount when the second battery is attached to the second battery mount.

2. The cooler according to claim 1, wherein the first battery mount and the second battery mount have different interfaces.

3. The cooler according to claim 2, wherein the first battery mount is configured to receive the first battery with a first rated voltage, and the second battery mount is configured to receive the second battery with a second rated voltage different from the first rated voltage.

4. The cooler according to claim 2, wherein the first battery mount is configured to receive the first battery having a first outer dimension, and the second battery mount is configured to receive the second battery having a second outer dimension different from the first outer dimension.

5. The cooler according to claim 1, wherein the first battery mount is configured to receive the first battery with a first rated voltage, and the second battery mount is configured to receive the second battery with a second rated voltage different from the first rated voltage.

6. The cooler according to claim 5, wherein the first battery mount is configured to receive the first battery having a first outer dimension, and the second battery mount is configured to receive the second battery having a second outer dimension different from the first outer dimension.

7. The cooler according to claim 1, wherein the first battery mount is configured to receive the first battery having a first outer dimension, and the second battery mount is configured to receive the second battery having a second outer dimension different from the first outer dimension.

8. The cooler according to claim 1, wherein the first battery mount and the second battery mount are connected in parallel.

9. The cooler according to claim 1, further comprising:

a battery compartment (i) having a first surface and a second surface and, (ii) configured to receive the first battery and, alternatively, the second battery, wherein the first surface and the second surface are transverse,
the first battery mount is on the first surface, and
the second battery mount is on the second surface.

10. The cooler according to claim 9, wherein
the first surface and the second surface are orthogonal to each other.

11. The cooler according to claim 9, wherein
the battery mount set includes a first battery mount set and a second battery mount set.

12. The cooler according to claim 11, wherein
the second surface includes a second surface adjacent to a first end of the first surface and a second surface adjacent to a second end of the first surface,
the first battery mount set includes a first battery mount on the first surface,
the second battery mount set includes a first battery mount on the first surface,
the first battery mount set includes a second battery mount on the second surface adjacent to the first end, and
the second battery mount set includes a second battery mount on the second surface adjacent to the second end.

13. The cooler according to claim 12, wherein
the battery mount set is configured such that the first battery is attachable to the first battery mount in the first battery mount set and to the first battery mount in the second battery mount set only when the second battery is not attached to the second battery mount in the first battery mount set and to the second battery mount in the second battery mount set.

14. The cooler according to claim 12, wherein
the battery mount set is configured such that the second battery is attachable to the second battery mount in the first battery mount set and to the second battery mount in the second battery mount set only when the first battery is not attached to the first battery mount in the first battery mount set and to the first battery mount in the second battery mount set.

15. The cooler according to claim 12, wherein
the battery mount set is configured such that the second battery is attachable to the second battery mount in the first battery mount set and the first battery is attachable to the first battery mount in the second battery mount set when only the first battery is not attached to the first battery mount in the first battery mount set and the second battery is not attached to the second battery mount in the second battery mount set.

16. The cooler according to claim 12, wherein
the first battery mount in the first battery mount set, the second battery mount in the first battery mount set, the first battery mount in the second battery mount set, and the second battery mount in the second battery mount set are connected in parallel.

17. The cooler according to claim 11, further comprising:
a display configured to display a remaining battery level of at least one of the first battery or the second battery.

18. The cooler according to claim 17, wherein
the display includes
a first display section configured to display a remaining battery level of one of the first battery or the second battery attached to the first battery mount set, and
a second display section configured to display a remaining battery level of one of the first battery or the second battery attached to the second battery mount set.

19. The cooler according to claim 18, wherein
the first display section is configured to display the remaining battery level of the first battery when the first battery is attached to the first battery mount in the first battery mount set, or display the remaining battery level of the second battery when the second battery is attached to the second battery mount in the first battery mount set, and
the second display section is configured to display the remaining battery level of the first battery when the first battery is attached to the first battery mount in the second battery mount set, or display the remaining battery level of the second battery when the second battery is attached to the second battery mount in the second battery mount set.

20. The cooler according to claim 18, wherein
the display indicates whether the first battery and the second battery are being discharged.

* * * * *